US007082828B1

(12) United States Patent
Wilkins

(10) Patent No.: US 7,082,828 B1
(45) Date of Patent: Aug. 1, 2006

(54) LASER MEASUREMENT OF LIQUID LEVEL IN A HOLDER

(75) Inventor: Larry C. Wilkins, Ft. Lauderdale, FL (US)

(73) Assignee: Electromechanical Research Laboratories, Inc., Albany, IN (US)

( * ) Notice: Subject to any disclaimer, the term of this patent is extended or adjusted under 35 U.S.C. 154(b) by 0 days.

(21) Appl. No.: 10/799,221

(22) Filed: Mar. 12, 2004

Related U.S. Application Data

(63) Continuation-in-part of application No. 10/350,630, filed on Jan. 24, 2003, now Pat. No. 6,715,437.

(60) Provisional application No. 60/430,437, filed on Dec. 3, 2002, provisional application No. 60/352,690, filed on Jan. 29, 2002.

(51) Int. Cl.
*G01F 23/52* (2006.01)

(52) U.S. Cl. ..... 73/313; 73/319

(58) Field of Classification Search ..... 73/313, 73/314, 319, 293, 290 V; 250/577; 342/124; 367/908; 33/719
See application file for complete search history.

(56) References Cited

U.S. PATENT DOCUMENTS

| | | | | |
|---|---|---|---|---|
| 4,050,819 A | | 9/1977 | Lichtman | 356/51 |
| 4,420,250 A | | 12/1983 | Kompa | 356/5.01 |
| 4,938,590 A | | 7/1990 | Ishida | 356/5.01 |
| 5,194,747 A | | 3/1993 | Culpepper et al. | 250/577 |
| 5,209,106 A | * | 5/1993 | Carlin | 73/49.2 |
| 5,257,090 A | * | 10/1993 | Meinzer et al. | 356/498 |
| 5,291,031 A | * | 3/1994 | MacDonald et al. | 250/577 |
| 5,412,978 A | | 5/1995 | Boone et al. | 73/49.2 |
| 5,648,844 A | | 7/1997 | Clark | 356/5.09 |
| 5,668,308 A | | 9/1997 | Denby | 73/49.2 |

(Continued)

*Primary Examiner*—Hezron Williams
*Assistant Examiner*—Tamiko Bellamy
(74) *Attorney, Agent, or Firm*—Woodard, Emhardt, Moriarty, McNett & Henry LLP

(57) ABSTRACT

Leakage detection of cargo from the hold of a barge involves a mounting plate to the top hatch of the hold. Two pipes secured to the plate extend to locations near the bottom. Each pipe has a guide tube in it coaxial with the pipe. Each pipe has a float in it received around the guide tube. A float follower is in each tube and magnetically coupled to the float so that the float follower rises and falls with the float. One pipe has an open bottom for cargo to freely move up and down in the pipe as the hold is filled and emptied. The other pipe has a valve at the bottom for admitting cargo from the hold to the pipe at the port of origin of the vessel. Following loading of the cargo, the valve is closed. One embodiment tethers the floats to reels atop the plate. Any change of level of the floats, reflecting a loss of cargo during transit from the port of origin to that of destination, is reflected in relative rotation of the reels and triggering an output signal to an annunciator. Another embodiment employs lasers transmitting to and receiving from the float followers, reporting to a comparator producing an output signal to an annunciator upon recognition of a difference between distances indicated by laser output signals. A third embodiment eliminates the guide tubes, floats and float followers. Portable embodiments for measurement of liquid levels alone, and also useful for loss detection, include a carrier handle for hand carrying the measuring laser and computer from one tank to another in a multiple tank site or transporter to measure liquid levels in a number of tanks. Other embodiments include a portable combination ultrasonic measurement with laser measurement to indicate temperature in the atmosphere of the liquid level, along with indication of the level measurements.

14 Claims, 27 Drawing Sheets

U.S. PATENT DOCUMENTS

| | | | | |
|---|---|---|---|---|
| 5,767,400 | A | 6/1998 | Nakano et al. | 73/152.46 |
| 5,900,546 | A | 5/1999 | Wilkins | 73/290 V |
| 6,123,508 | A | 9/2000 | Ching | 417/40 |
| 6,216,623 | B1 | 4/2001 | Wilkins | 114/74 A |
| 6,323,441 | B1 | 11/2001 | Hager et al. | 177/1 |
| 6,390,157 | B1 | 5/2002 | Moogdaharn et al. | 141/383 |
| 6,412,344 | B1 | 7/2002 | Danicich et al. | 73/290 V |
| 6,715,437 | B1 | 4/2004 | Wilkins | 114/74 R |

* cited by examiner

LASER MEASUREMENT OF LIQUID LEVEL IN A HOLDER

This application is a continuation-in-part of patent application Ser. No. 10/350,630 filed Jan. 24, 2003 now U.S. Pat. No. 6,715,437 and which is based on provisional patent application Ser. No. 60/430,437, filed Dec. 3, 2002, which was based on provisional patent application Ser. No. 60/352,690, filed Jan. 29, 2002, and priority is claimed based on all of these applications.

BACKGROUND OF THE INVENTION

This invention relates generally to liquid cargo containment, and more particularly to a system for measurement of the level of the surface of liquid in a holder.

BRIEF DESCRIPTION OF PRIOR ART

In various circumstances, and for various reasons, it is desirable to be able to determine the level of the surface of liquid in a holder. Such information is often desired to determine the quantity of liquid in the holder. Various ways and means for various purposes are described in my U.S. Pat. No. 5,900,546 issued May 4, 1999, U.S. Pat. No. 6,216,623 issued Apr. 17, 2001 and patent application Ser. No. 10/350,630, and references cited therein.

Various problems are encountered in efforts to measure the level of liquid in a holder, particularly if it is a large holder containing a large quantity of liquid. Such problems include, among others, nature of the liquid, access to it, depth of the holder and environmental conditions. If it is desired to determine the quantity of liquid in a tank, a change in the surface level between times of measurement may indicate a change in quantity of liquid contained, or it may result from the impact of a change in temperature of the liquid between the times of measurement. This can undermine the significance of comparisons of measurements made at different times. The present invention is addressed to such problems. It can be important if a goal is to detect loss of liquid from a holder due to evaporation, leakage, or pilferage, and can apply to holders that are stationary, or transported such as in a railway tank car, a transport truck or a floating vessel.

DESCRIPTION OF THE ILLUSTRATED EMBODIMENTS

Figure 1:
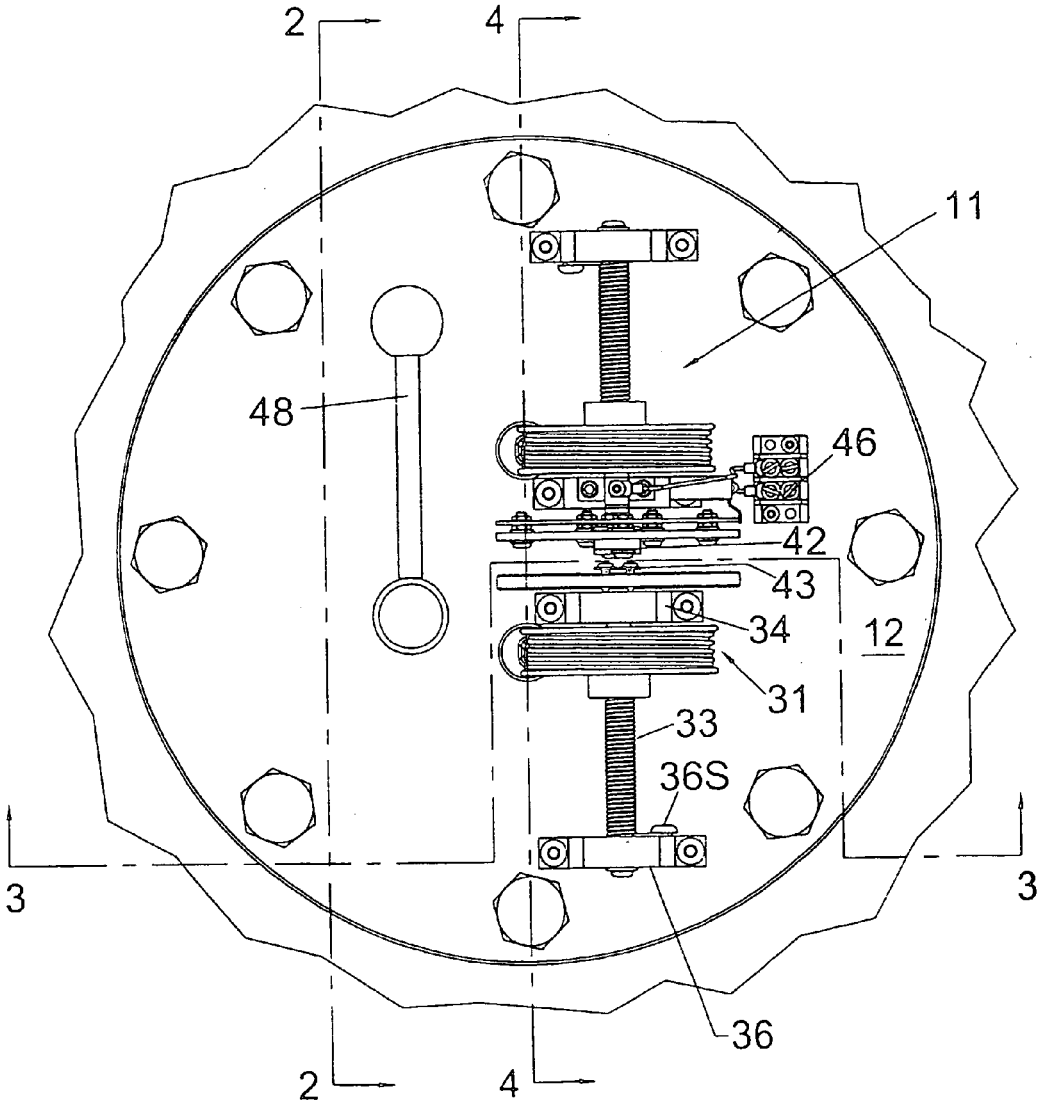
FIG. 1 is a top plan view of a hatch cover atop a cargo hold (shown fragmentarily) of a vessel and incorporating one embodiment of the present invention therein.
Figure 2:
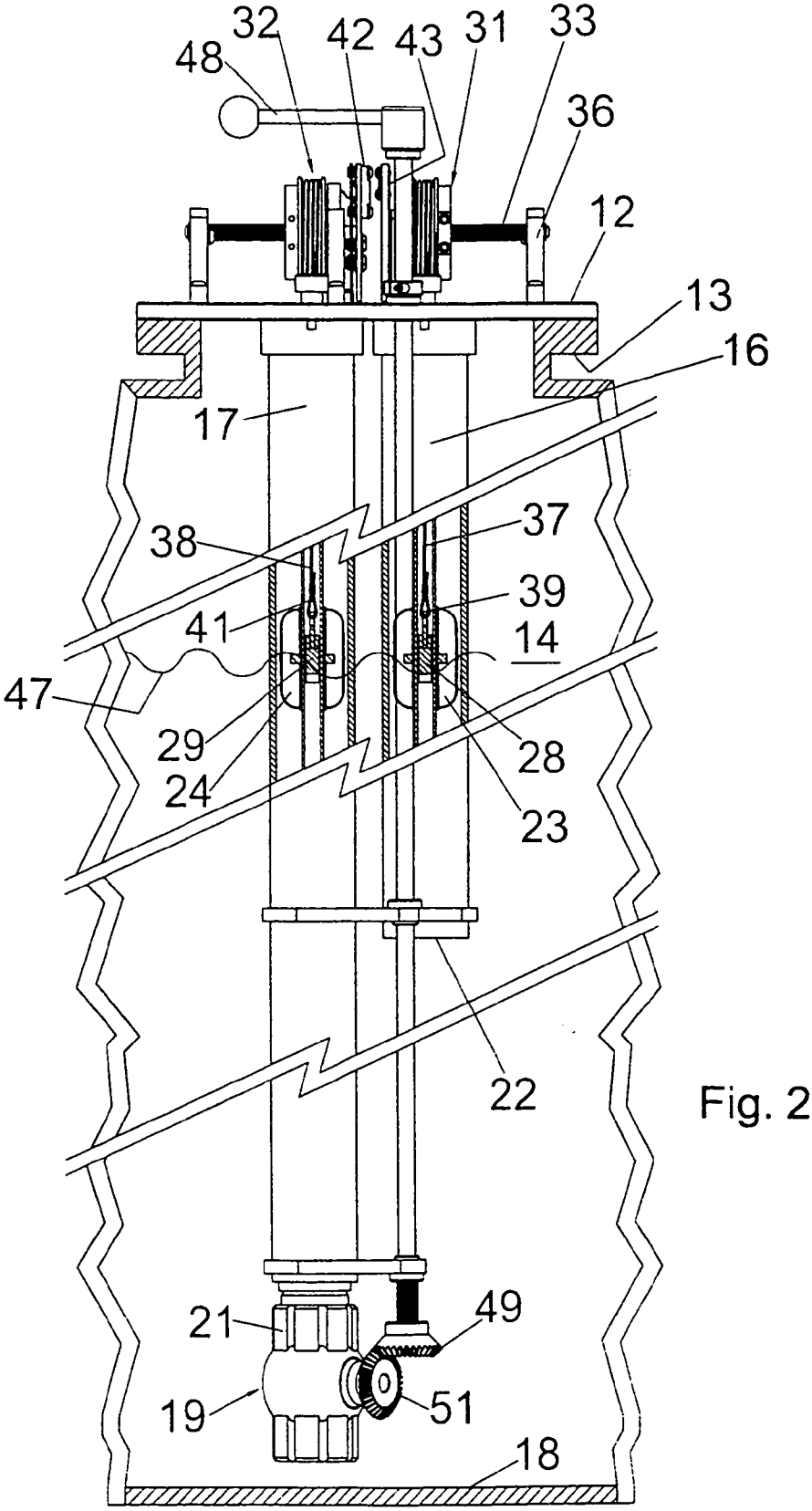
FIG. 2 is a vertical sectional view into the cargo hold, and taken at line 2—2 in FIG. 1 and viewed in the direction of the arrows.
Figure 3:
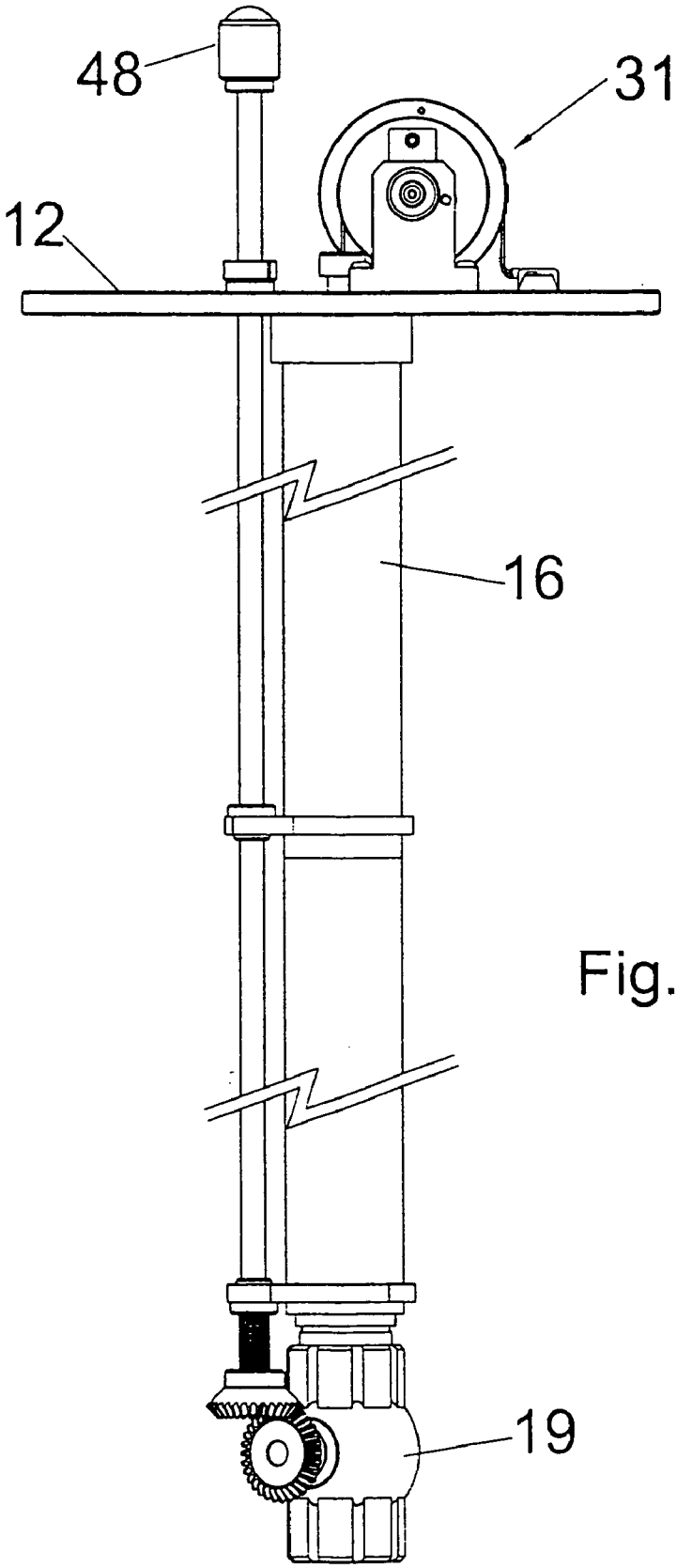
FIG. 3 is a section of the gauge assembly taken at line 3—3 in FIG. 1.
Figure 4:
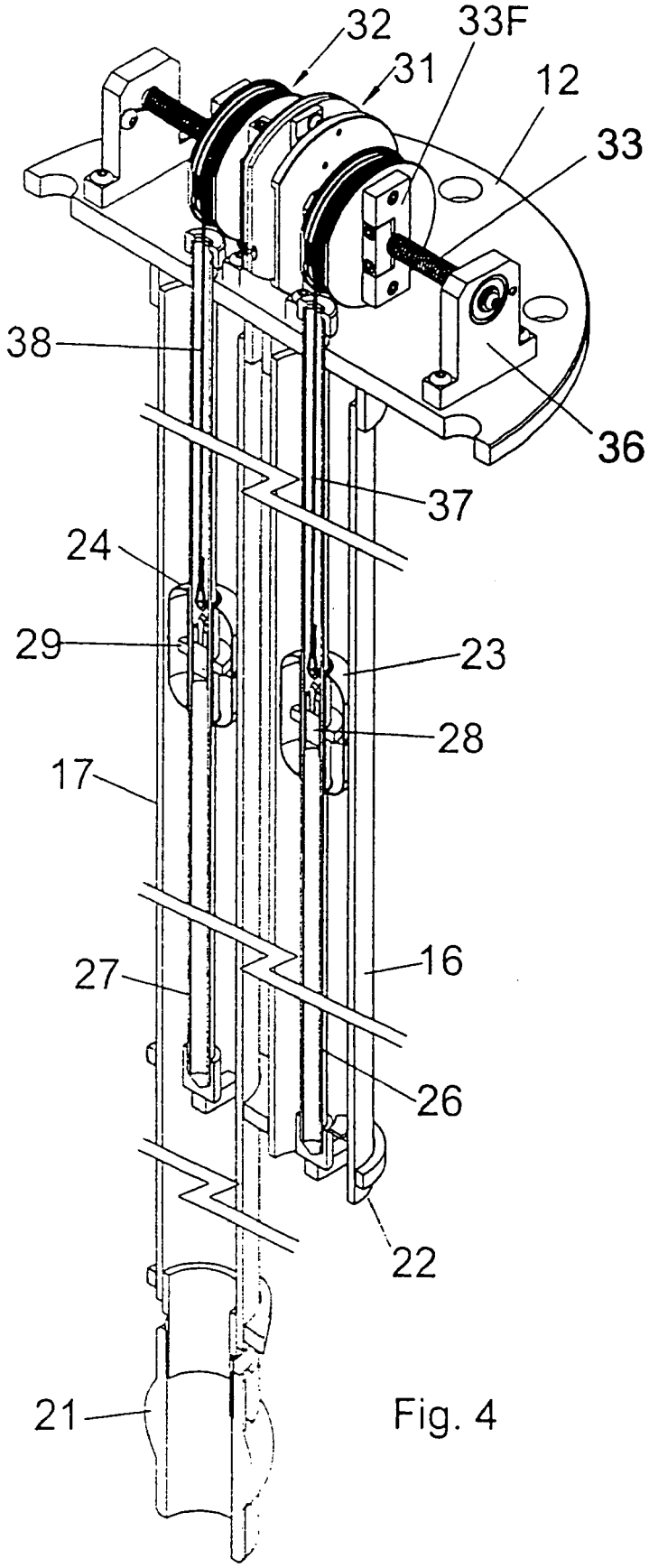
FIG. 4 is a cutaway perspective section taken at line 4—4 in FIG. 1 and omitting interior details of a ball valve.
Figure 5:
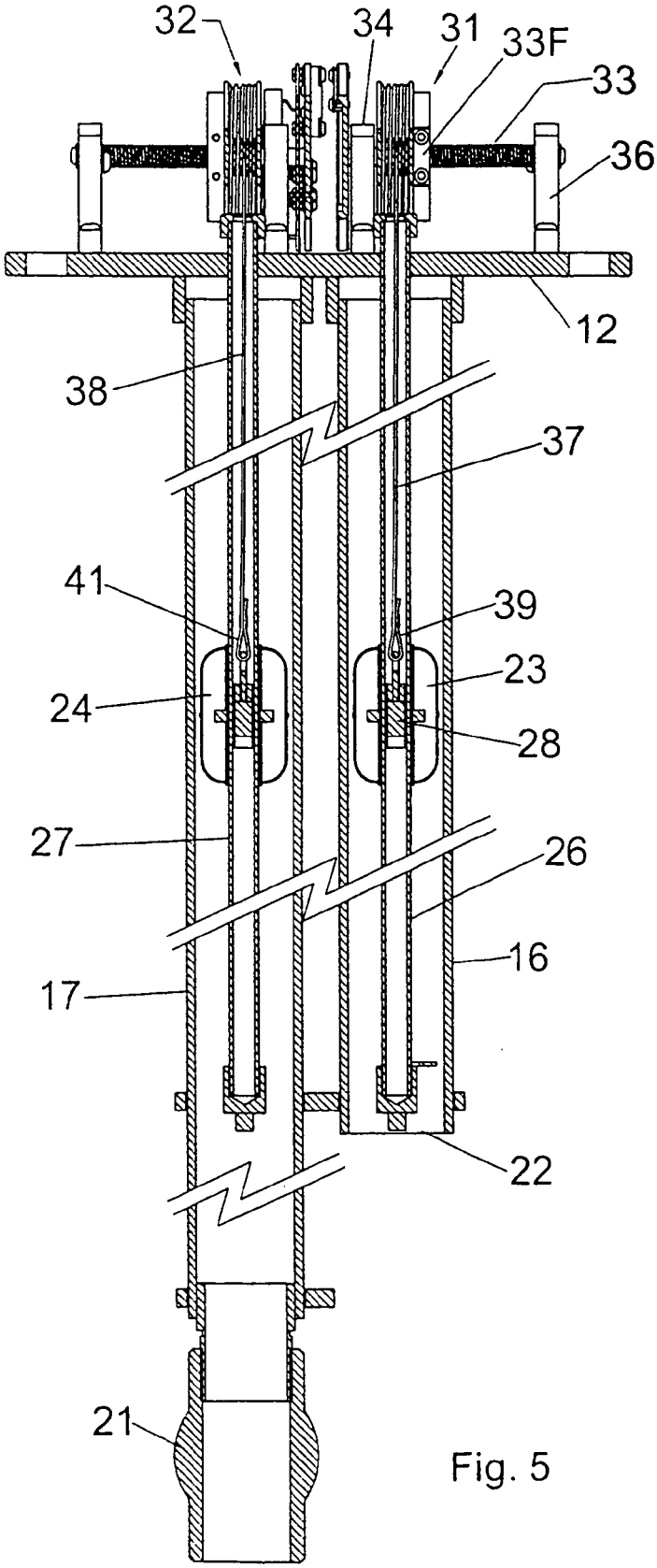
FIG. 5 is a vertical section also taken at line 4—4 in FIG. 1.
Figure 6:
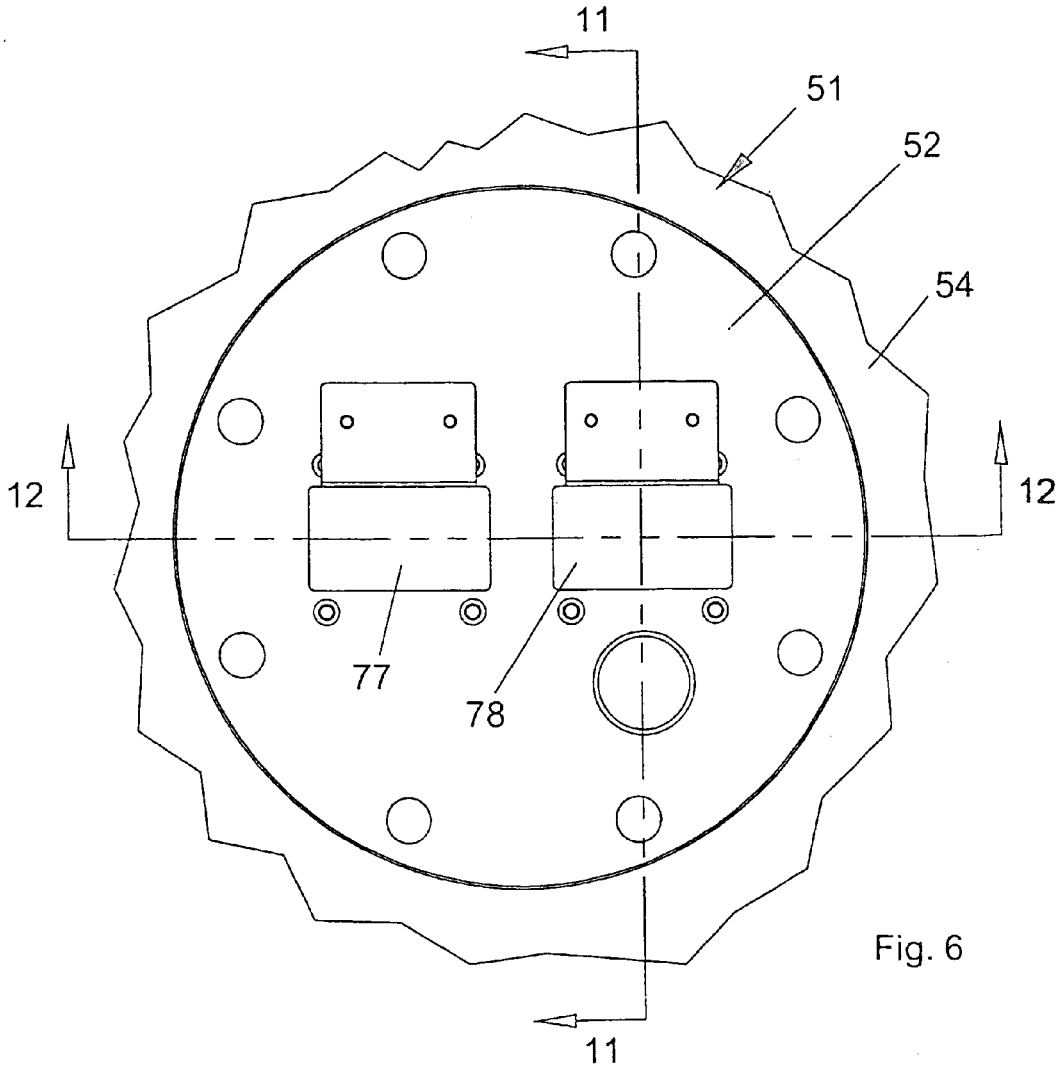
FIG. 6 is a top plan view of a hatch cover according to a second embodiment of the invention and located atop a cargo hold (shown fragmentarily) of a vessel.

For the purposes of promoting an understanding of the principles of the invention, reference will now be made to the embodiments illustrated in the drawings, and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, portions are omitted at the break lines in FIGS. 2–5, 7–12, 14 and others to conserve vertical space in the drawings. Referring particularly to the embodiment shown in FIGS. 1–5, gauge assembly 11 is mounted to a hatch cover plate 12 atop an access port flange 13 of a cargo hold 14 of a vessel. Two parallel pipes 16 and 17 are connected to the plate 12 and extend downwardly from it. One of the pipes 17 extends to a point near the bottom 18 of the hold, and a ball valve 19 is located at the lower end 21 of the pipe. The other pipe 16 extends down to a level near to, but above, the level of the valve assembly. The lower end 22 of the second pipe is open.

Two floats 23 and 24 are provided, one in each of the pipes. Each float surrounds a guide tube 26 and 27 inside the pipe and which extends down from the plate 12 and serves as a guide for the float as it moves up or down in response to a change of level of cargo in the hold.

A float follower 28 and 29 is received inside each tube and moves with the float in response to magnetic coupling with a magnet in the float.

Two reels 31 and 32 are mounted (as on a shaft mounted on pillow blocks 34 and 36 for reel 31, for example) for free rotation above the plate 12. Each reel stores a filament or cable 37, 38 having an end connected to the top of a float follower as at 39, 41. The reels are provided with take-up springs to avoid slack in the line from the reel to the float, but the spring tension is modest and adjustable so that the floats in both pipes, when valve 19 is open, will respond identically to a change in cargo level. In the illustrated example, a coil spring is mounted concentrically on a reel mounting shaft, such as spring 33 for the shaft mounting reel 31. One end of the spring 33 is anchored at pillow block screw 36S (FIG. 1). The other end is clamped to the outboard face of reel 31 at 33F.

The reels have a combination of proximity switches, such as a magnetic reed switch 42 on reel 32 and switch actuator magnet 43 on the other reel 31, so that if there is a difference in float height, the officer in charge of the cargo can be alerted accordingly. Electrical conductors run from the switch 42 to the terminal block 46, to which monitoring or alarm equipment can be connected.

The sensing of any difference of float height is enabled by having the valve 19 at the bottom of the one pipe. It is open when the hold is loaded with cargo. Thus, both pipes will be filled with cargo to the height 47 (FIG. 2) of the cargo in the hold when it is filled. Then the valve 19 is closed by a handle 48 at the top, operating through mating gears 49, 51 to close the valve. Then, as long as there is no loss of cargo, both floats will remain at the same height in the two pipes, regardless of changes of temperature of cargo, since both pipes are immediately adjacent each other and submerged in the same cargo. In addition, because of the length of the open pipe 16 so that cargo access into it, whether in the wall or at the bottom end as shown, is at a substantial depth in the cargo hold, it is not susceptible to wave action.

It should be understood that a goal of this arrangement is to be able to detect cargo losses which are a small percentage of the original quantity stored in the hold. Accordingly, with equal weights of floats, float followers, follower tethering line 37, 38, and tensioning on the reels, and calibration of the reed switch or other sensors employed between the two reels, the change of float height can be related to the total cargo quantity to provide detection and an alarm, if a loss occurs in excess of a percentage of the total fill volume predetermined to be a maximum tolerable.

Referring now to the embodiment of FIGS. 6–12, the gauge assembly 51 is mounted to hatch cover plate 52 atop an access port flange 53 (FIG. 12) of a cargo hold 54 of a vessel. The cover plate may be mounted to the flange in any suitable means. A series of circularly spaced holes for bolts is shown as an example.

Two parallel pipes 56 and 57 are mounted to the plate 52 and extend downwardly from it. One of the pipes 56 has a lower end 58 to which is fixed and sealed, a control valve seat assembly 59. It includes a mounting ring 59M and a valve seat plate 59S fixed and sealed to the ring 59M and which has a lower surface 61 near the bottom 62 of the cargo hold 54. The lower end 63 of pipe 57 is open. Guide tubes 64 and 66 secured in plate 52 extend downward through the plate and concentric with the pipes 57 and 56, respectively. Floats 67 and 68 received in pipes 57 and 56, respectively, encircle the guide tubes 64 and 66, respectively, and are movable axially along them. Each of the floats has a magnet ring in it such as 69 in 67 and 71 in 68. Float follower magnets 72 and 73 are within the tubes 64 and 66, respectively, and move with its respective float in response to magnetic coupling with the magnet in the float. The tops 74 and 76 of the float followers 72 and 73, respectively, are reflective surfaces to reflect impulses from lasers 77 and 78 mounted atop the cover plate 52. As in the FIGS. 1–5 embodiment, the lower ends of the guide tubes 64 and 66 of this second embodiment are received in stabilizing bridges 79 and 81, respectively, spanning the interior of the pipes 57 and 56, respectively, across their diameters.

Figure 13:
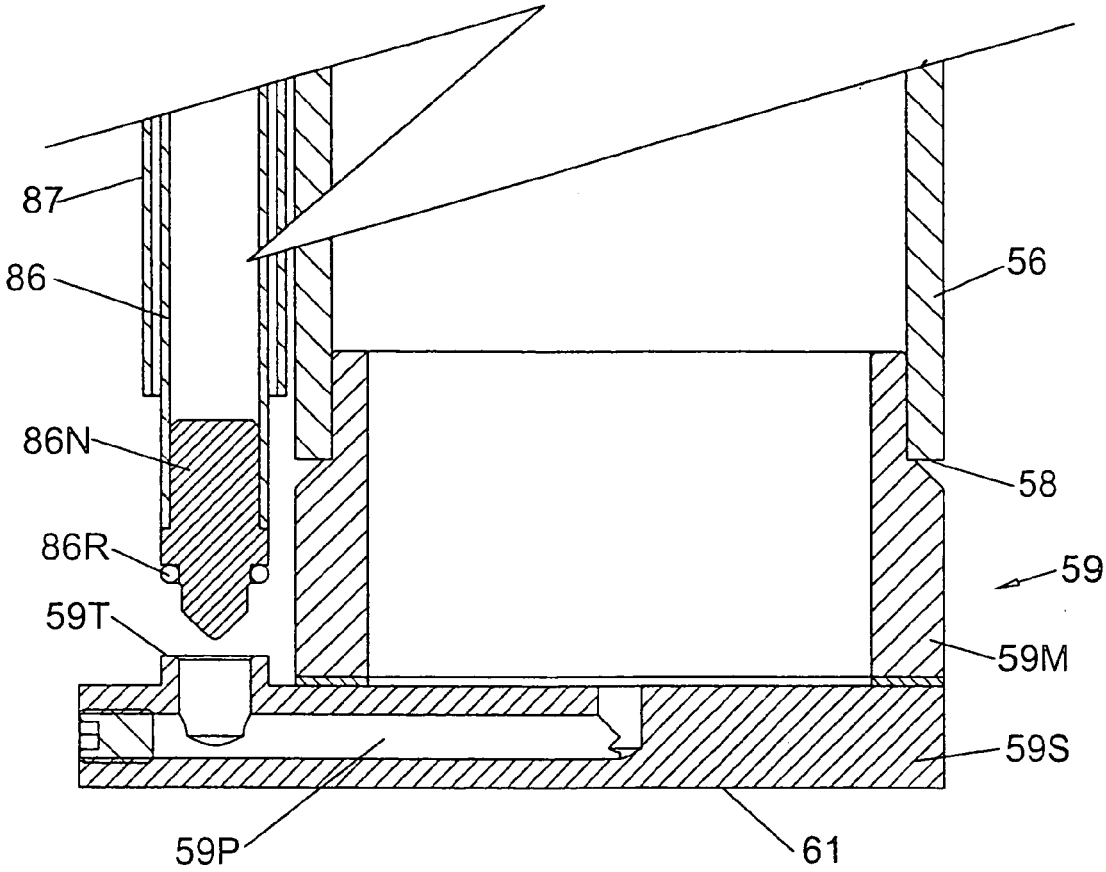
FIG. 13 is an enlarged sectional view showing details of the control valve.
Figure 14:
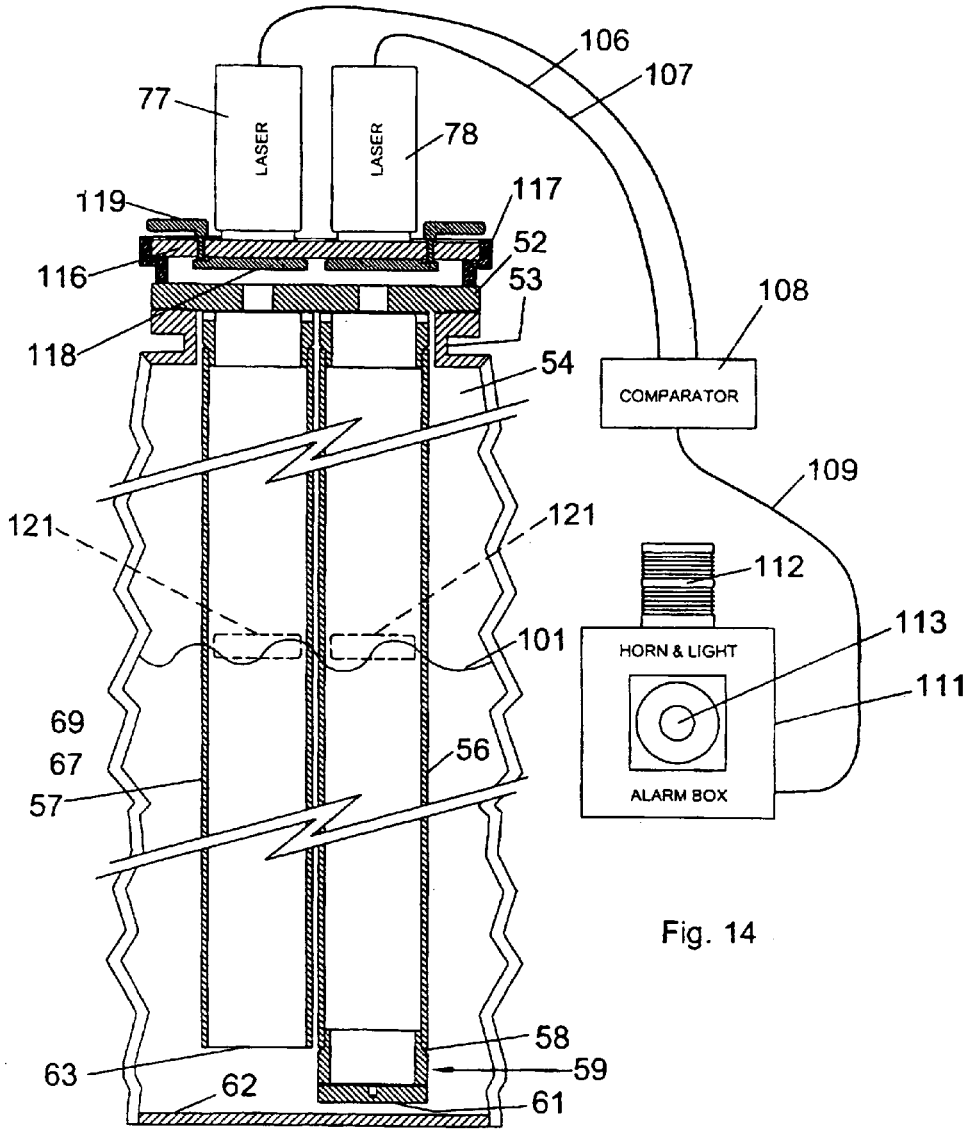
FIG. 14 is a view similar to FIG. 12 but showing a third embodiment of the invention.

As shown best in FIG. 13, the control valve seat assembly 59 includes a mounting ring 59M which is received and sealed in the lower end of the pipe 56. The lower end of the mounting portion is sealed and seated to the seat plate 59S which has an upwardly opening valve seat 59T. A passageway 59P communicates from the opening encircled by the valve seat to a central opening under the float 68 in pipe 56.

A valve plunger rod shown as a tube 86 has a plug 86N at its lower end. The plug has a tapered tip to center it in the seat 59T. A sealing member in the form of O-ring 86R (FIG. 13) is received and retained on a shoulder above the tip of plug 86N.

Figure 7:
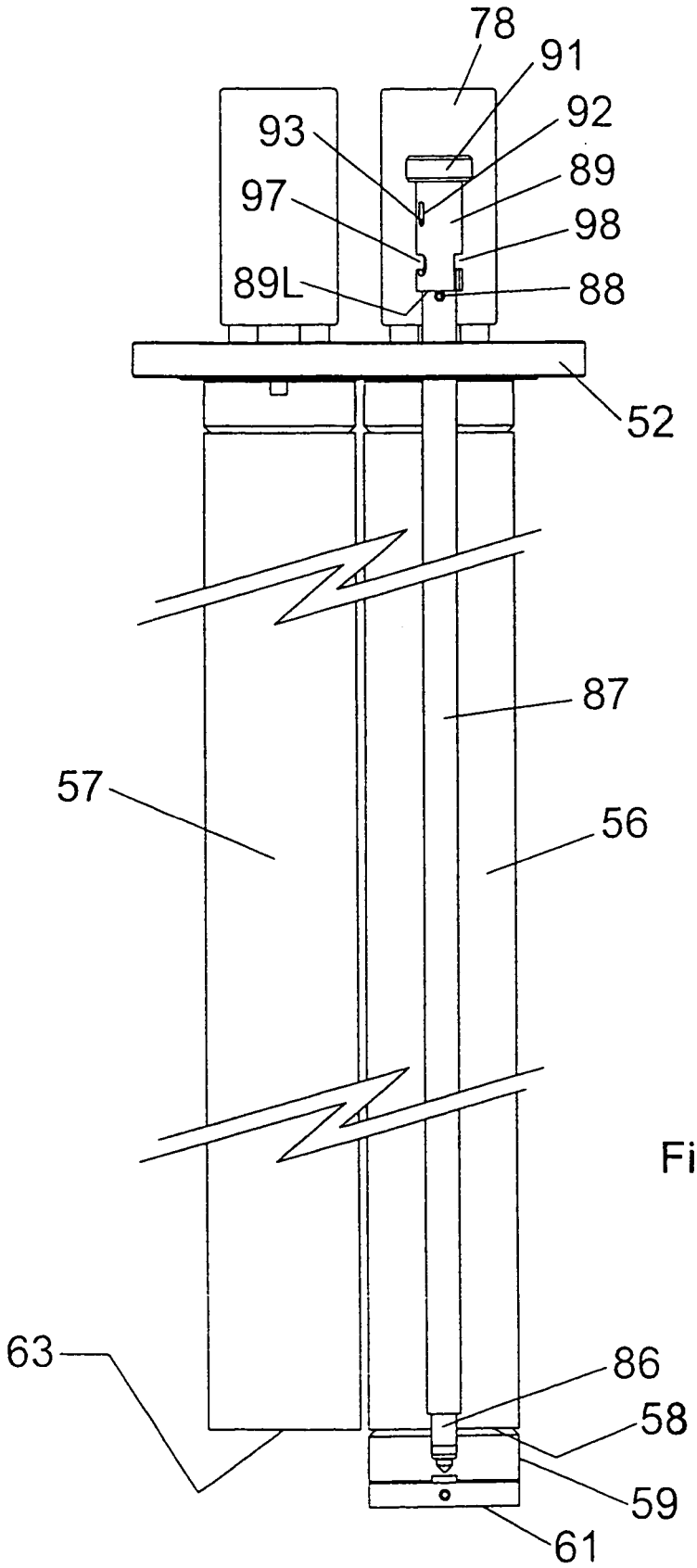
FIG. 7 is a front view thereof with a control valve open and portions of the overall height of the assembly broken out to conserve space in the drawing as is done in the rest of the views.
Figure 8:
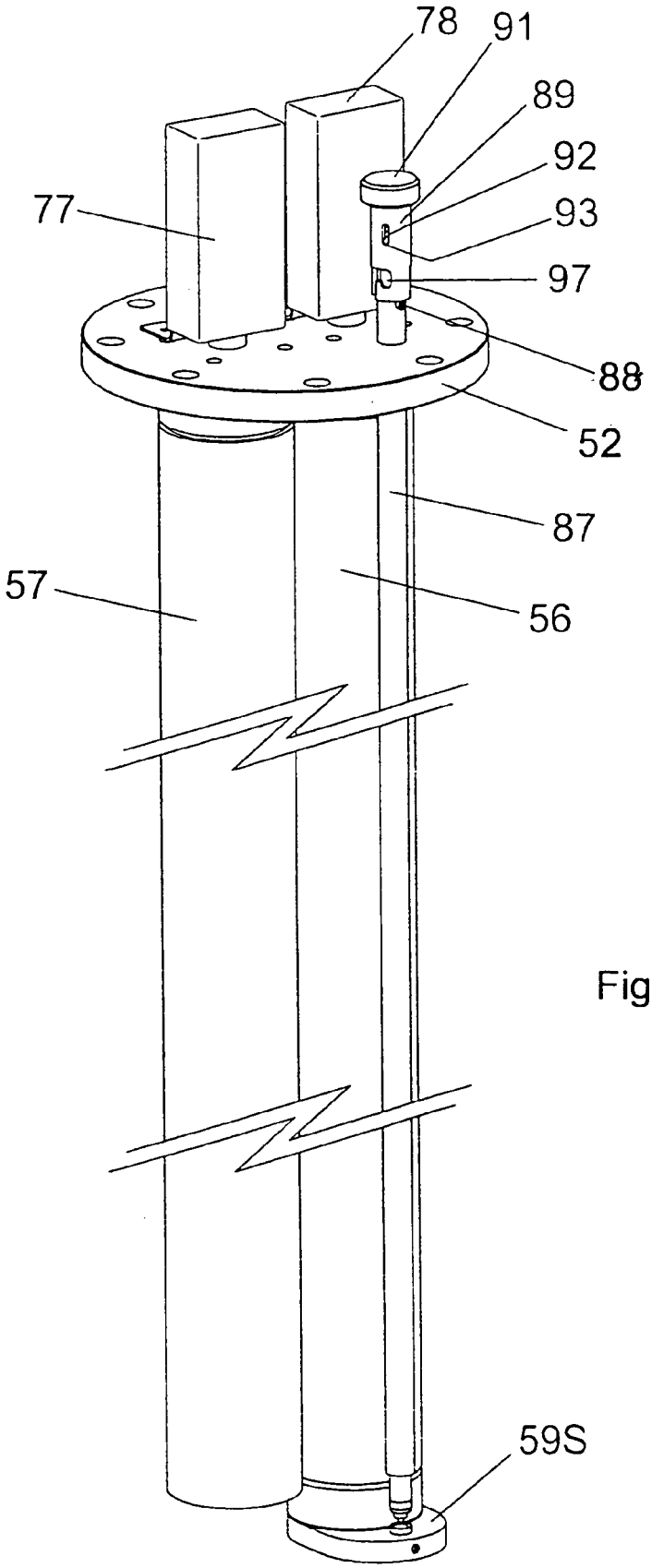
FIG. 8 is a frontal isometric view thereof with the control valve open.
Figure 9:
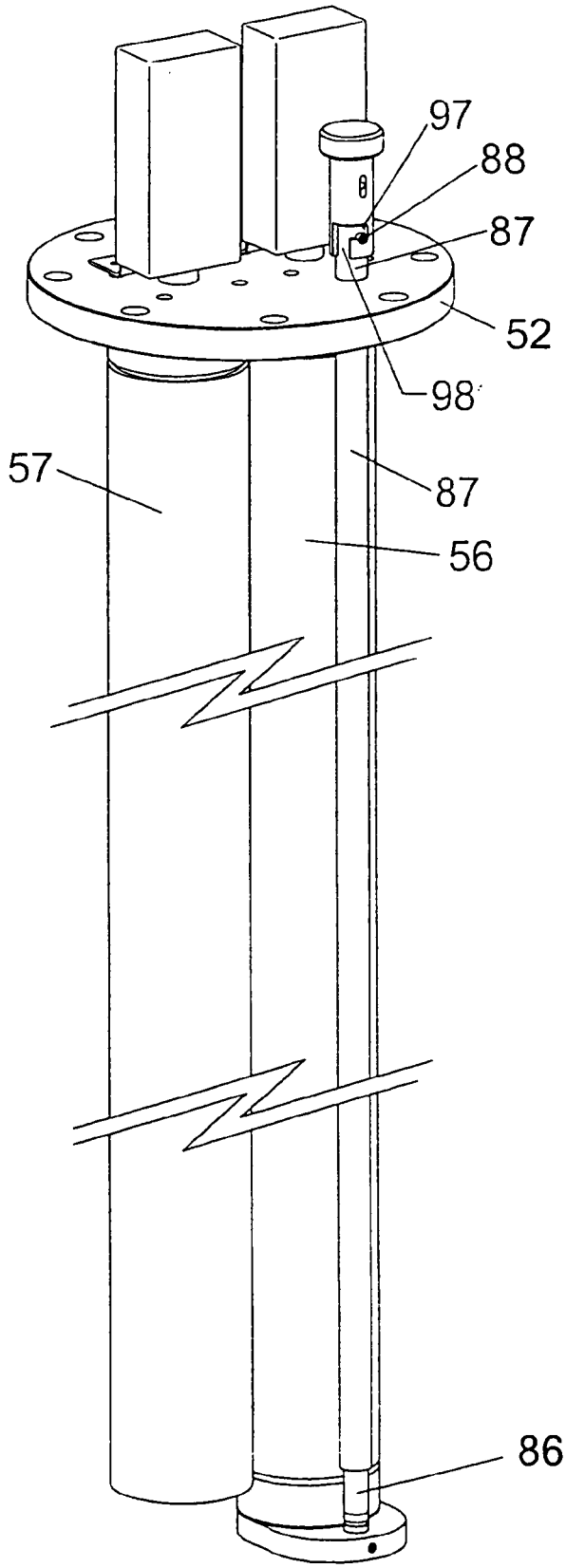
FIG. 9 is an isometric view thereof with the control valve closed.
Figure 10:
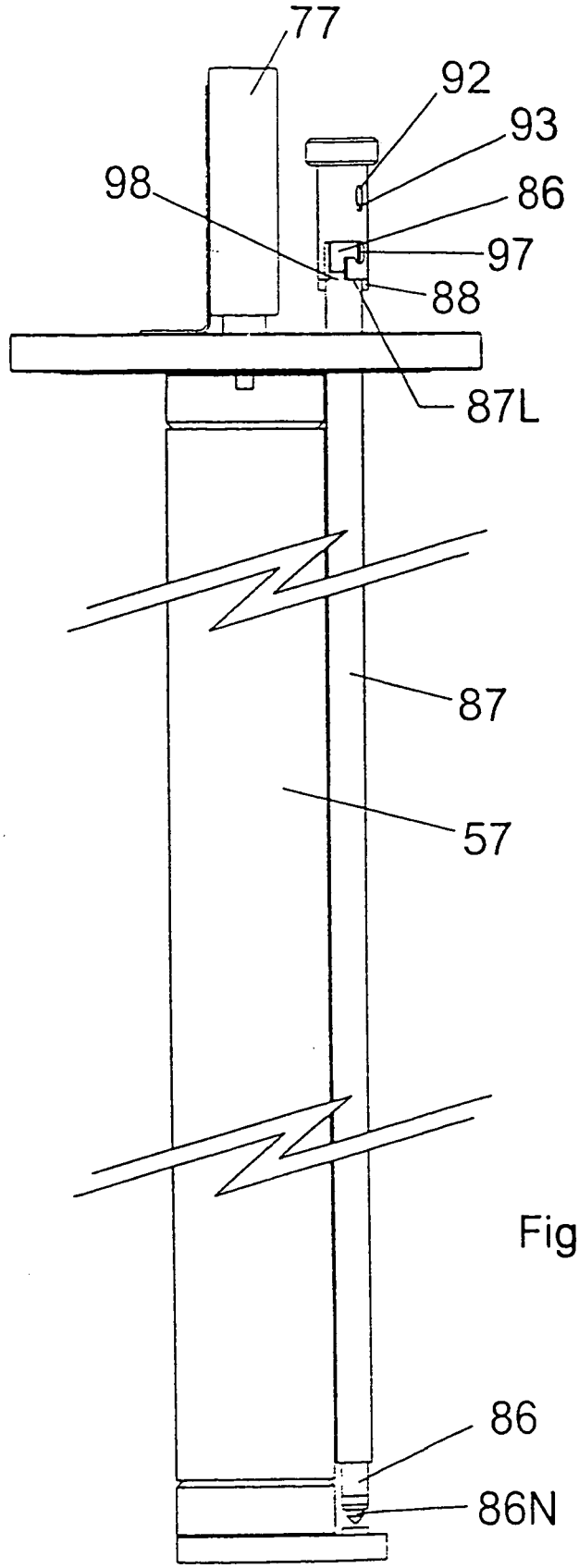
FIG. 10 is a left-side view thereof with the control valve open.
Figure 11A:
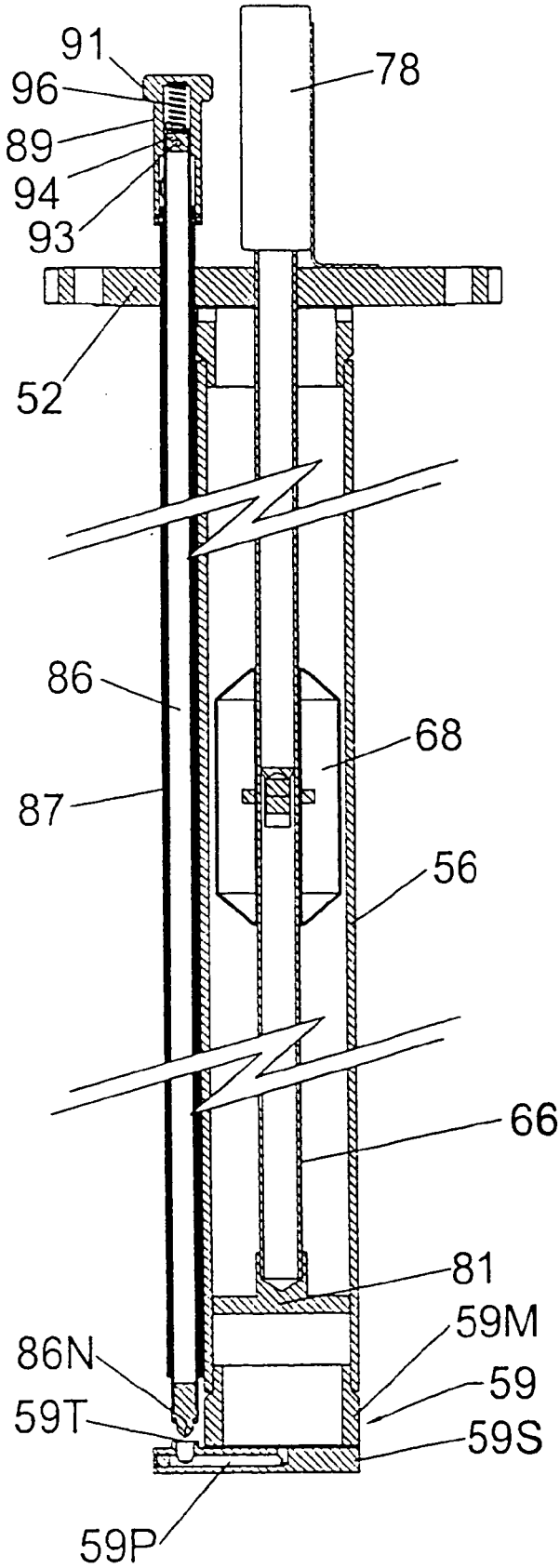
FIG. 11A is a section therethrough with the valve open taken at line 11—11 in FIG. 6 and viewed in the direction of the arrows.
Figure 11B:
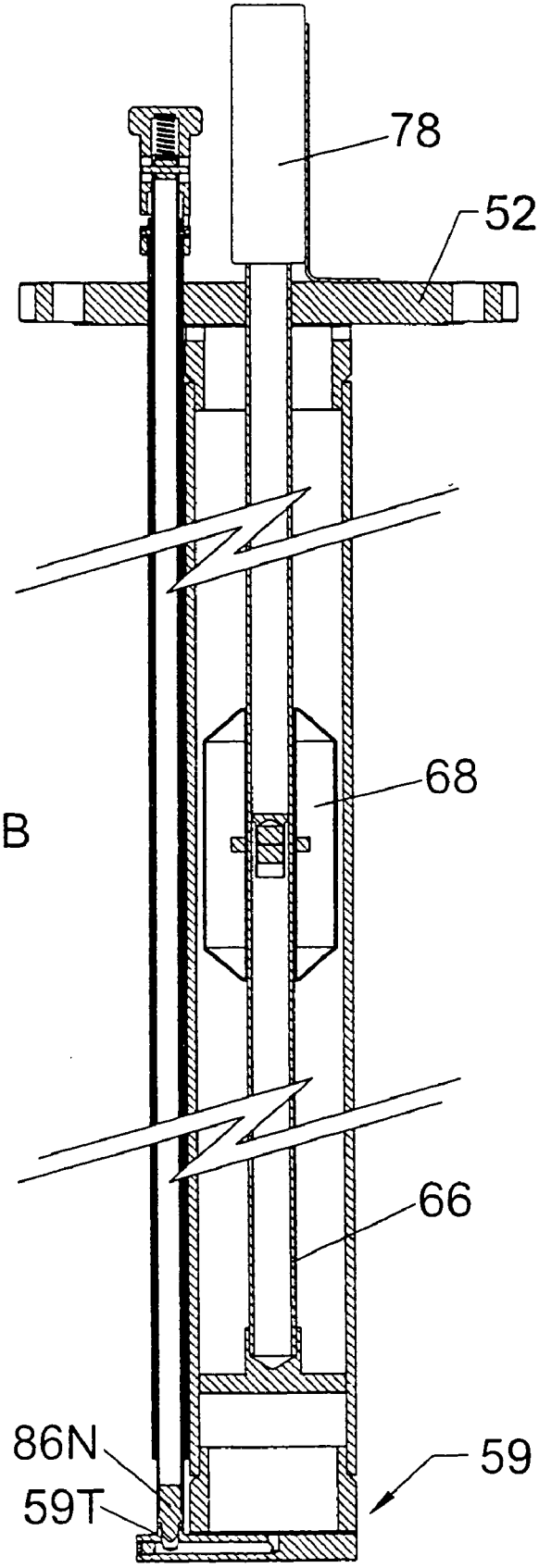
FIG. 11B is a view like FIG. 11A but with the valve closed.

The rod 86 is slidably received in tube 87, which is secured to the pipe 56 and projects upward through and is affixed to plate 52. Tube 87 has a pin 88 projecting laterally from it. Referring specifically to FIGS. 7 and 8, a sleeve 89 with knob 91 at its top has a slot 92 in it receiving a pin 93 projecting laterally from the block 94 (FIG. 11A) fixed to the top of the plunger rod 86. A spring 96 is captured between the underside of the knob 91 and the top of block 94. The sleeve 89 has a bayonet slot with latch portion 97 shown on one side of the sleeve in FIG. 7 and the rest of it shown at 98 in FIG. 7. Therefore, when this sleeve is in the position shown in FIG. 7, the lower end 89L of the sleeve is engaged with pin 88, holding the sleeve up resting on pin 88, at which time the pin 93 in block 94 is held up, thus holding up the rod 86 and thereby holding O-ring 86R up off the seat 59T in the valve seat plate 59S. To close the valve, the knob 91 is turned clockwise or counterclockwise about its axis, enabling the slot portion 98 to pass the pin 88. The knob 91 is then pushed downward manually, whereby the spring 96 urges the rod 86 downward to engage the O-ring 86R with the seat 59T and close the valve. The knob can be pushed further downward until the lower end of the hook portion 97 of the slot in the sleeve can engage pin 88 as shown in FIG. 9 and retain the O-ring engaged with the seat under the urging of the spring 96. The valve can be opened thereafter by simply reversing the procedure, pushing the knob 91 down and turning the sleeve 89 to release the notch 97 from pin 88 and allow the engagement of slot 92 with pin 93 to raise the rod 86 and then further turning of the sleeve 89 to again seat the lower edge 89 thereof on the pin 88 in the tube 87. If it is ever necessary to replace the O-ring, the rod 86 can be pulled completely out of tube 87 by simply pulling up on knob 91.

For utility on containers which carry flammable liquids, and to avoid the possibility of sparks, the above described embodiments isolate the cargo from the electrical components of the equipment. This is done by using the tubes internal to the pipes, and the float followers within the tubes. It is believed that a broad aspect of the invention can be practiced in a simpler form requiring fewer parts, when the measuring sensors are lasers with the capability to perform accurately while sending the laser signal through glass. In this embodiment, shown schematically in FIG. 14, the floats and tubes inside the pipes may be omitted. A window 116 in frame 117 is mounted atop and sealed to the cover plate 52 around a suitably sized opening in the plate. The lasers 77 and 78 are mounted on top of or above the window and oriented for the beams direct to the surface of the liquid in the pipes. If there is any doubt that the reflection from certain types of cargo liquid back to the laser would be of sufficient strength or clarity, and to provide universal utility of the apparatus, it may be equipped with a float in each of the pipes to receive and reflect the beam back to the laser. This is represented by the dotted lines 121 in FIG. 14. Also, to preclude any concern about clouding or otherwise obscuring clarity of the lower surface of the window, the window may be a sight glass with wiper 118 and operating handle 119 such as disclosed in my U.S. Pat. No. 5,284,105, or some other means may be used to deal with such problem. A separate window may be used for each laser to pipe combination, but it is believed that a single window as shown will be more convenient.

If the lasers preferred for use with the latter two embodiments of the invention would be inconvenient to mount precisely as shown, mirror arrangements may be used to direct the beams down the tubes or pipes. Also, although the orientation of the pipes and tubes in the various embodiments is preferably vertical and in parallel relation, it is possible that some variations from vertical and/or from parallelism may be made and remain within the scope of the present invention.

Operation

Figure 12:
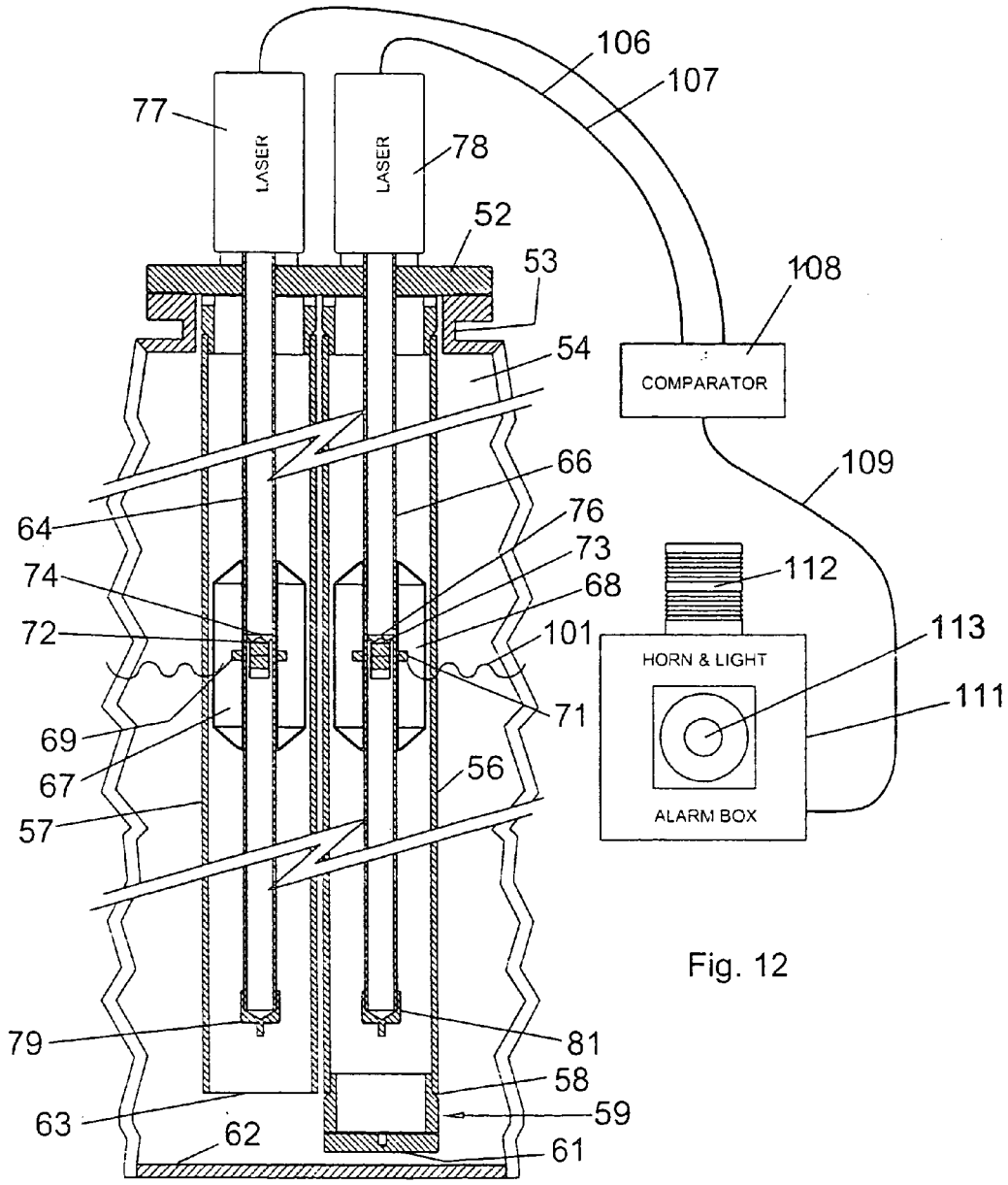
FIG. 12 is a sectional view thereof taken at line 12—12 in FIG. 6 and viewed in the direction of the arrows and showing, schematically, some additional components.

For purposes of example, it will be assumed that the cargo hold is filled to a level designated 101 in FIG. 12. Regardless of where that is in the hold, and what percentage of hold capacity it represents, the intent is to be alerted in the event of any loss of cargo from the hold during the passage of time. For that purpose, while the cargo hold is filled, the bottom of pipe 57 is open and the float can rise freely. The valve assembly on pipe 56 must be open to admit cargo to that pipe as well. Thus, when the level of cargo has stabilized in the cargo hold, both floats will be at the same level. Then the valve is manually shut and remains so until the cargo has reached it intended destination. Meanwhile, periodically during transit of the cargo from its shipment site toward its destination, the laser units 77 and 78 are activated. They transmit pulses down the respective tubes 64 and 66 and receive the reflected signals from the tops of the float followers. It should be understood, of course, that the laser assemblies 77 and 78 also include the receivers as well as transmitters. Receiver outputs on cables 106 and 107 are fed to an electronic comparator 108. As the lasers are identical and transmit pulses at reasonably close intervals, the distances indicated by the time from transmission to the time of reception of a reflected signal should be the same from both lasers. If they are not both representative of the same elapsed time from transmission to reception in both lasers, it is an indication of loss of cargo. Consequently, an alarm output is transmitted on cable 109 to an alarm assembly 111 which may include a light 112 and horn 113. Of course, other signals from comparator 108 may be made to various locations for attention by those responsible for security of the cargo. One possible example of a usable laser is the Trimble® brand Spectra Precision Laser HD360.

It should be understood that all embodiments of the present invention described above and hereinafter can be used in containers other than cargo holds of vessels such as tanker ships and barges. Just a few examples are tanker trucks, railroad tanker cars and storage tanks. Also, although a comparison of float positions is achieved with the magnet and reed switch 43 and 42, respectively, in the first embodiment, and comparison of levels is achieved with the electronic signal comparator 108 in the second and third embodiments, optical, ultrasonic or other comparators might also be used.

Figure 15:
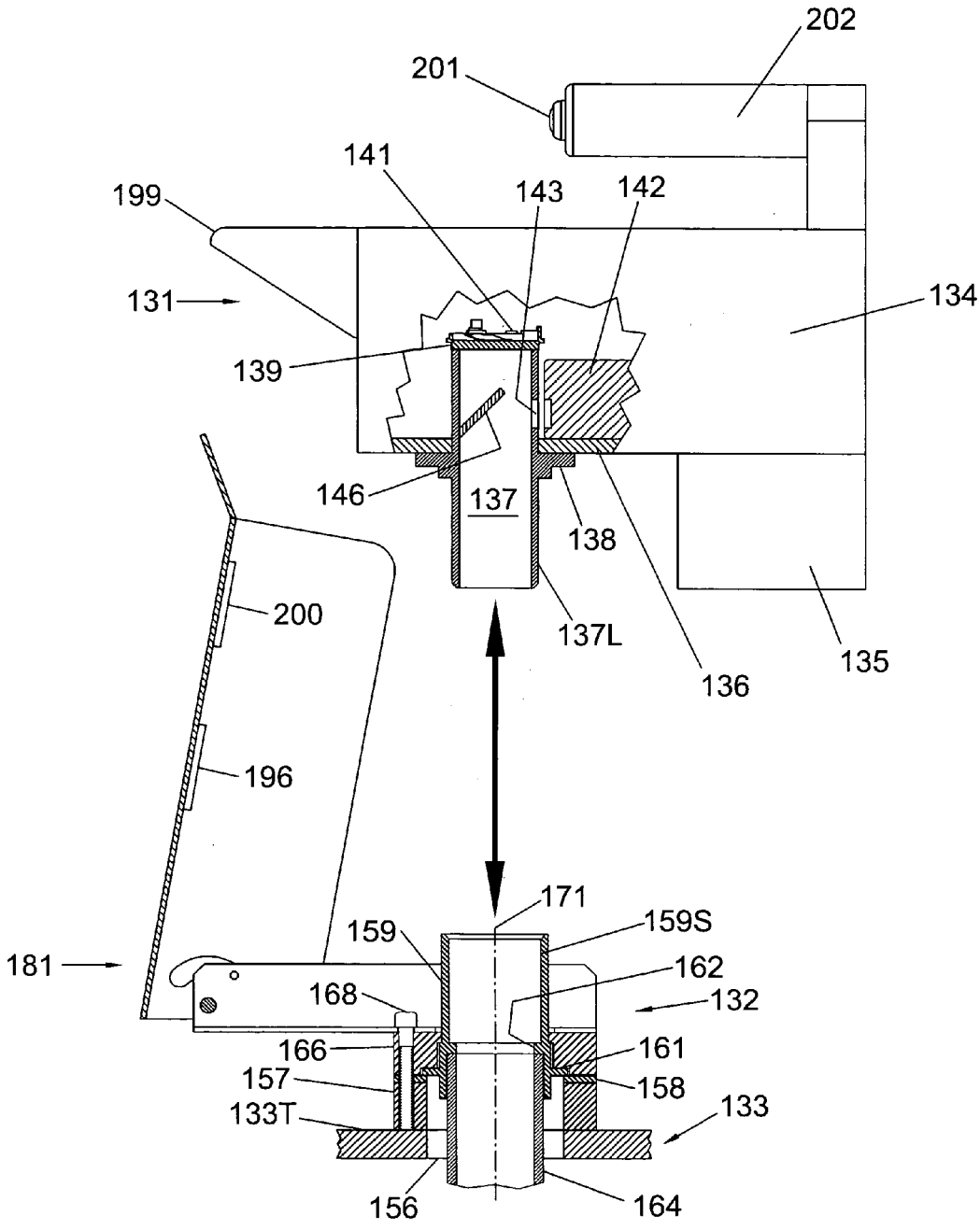
FIG. 15 is a side view, mostly in section, and showing a fourth embodiment of the present invention incorporating a hand-portable measurement portion of the apparatus.

Referring now to FIG. 15 and following, the measurement apparatus includes a portable measurement assembly 131 which is intended to be readily hand carried, and a receiver and target assembly 132 which is installed in the liquid containing holder 133. For liquid surface level measurement, the portable assembly is adapted to fit on the receiver assemblies of a plurality of liquid holders for which measurement of liquid level is of interest. The holder may be a bunker, a tank at a tank farm, a tank in a cargo hold of a vessel, a railway tank car, a tank at a loading dock, or any of many other types of holders. For convenience of description hereinafter, it will simply be referred to as a tank.

Figure 16:
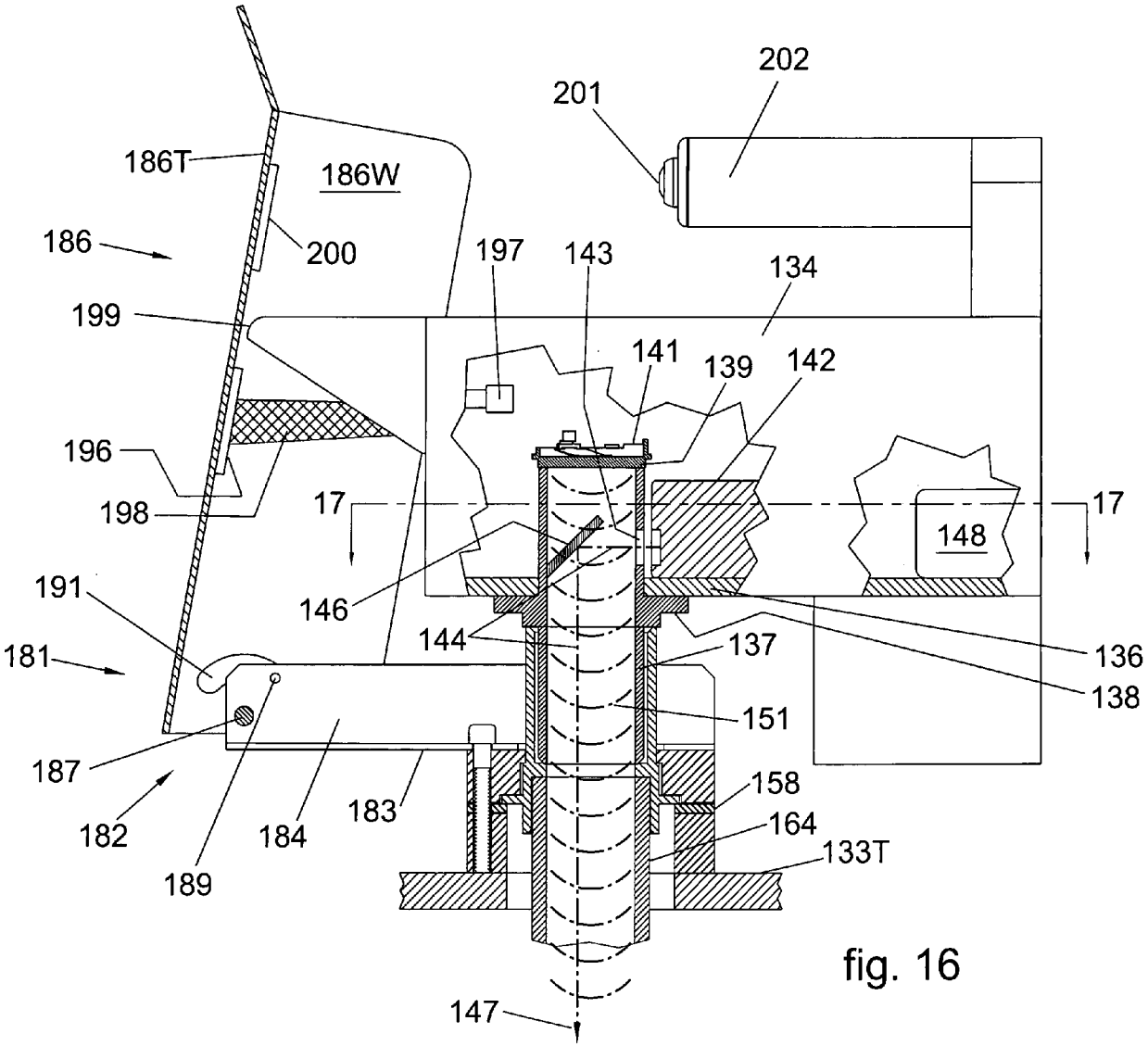
FIG. 16 is an enlarged side view, mostly in section, and showing a fifth embodiment of the present invention.

Referring particularly to FIGS. 15 and 16 of the drawings, the portable portion 131 of the measurement apparatus has a housing 134 with a base 136 and a battery case 135. A signal transmission tube 137 extends through the base and has a flange 138 secured to the base 136. A top plate 139 mounted to the top of the tube 137 supports an ultrasonic transducer 141 for sending and receiving ultrasonic signals along the tube.

A laser 142 is mounted in the housing on the base 136. There is a hole or window 143 in the wall of the tube 137 and facing the discharge window in the laser and through which the laser beam 144 (FIG. 16) shown by the dashed line, projects horizontally onto a reflector 146 from which the laser beam is reflected downward in the direction of arrow 147. This beam is reflected upward from a target at the level of the surface of the cargo in the tank and reflected horizontally by the mirror 146 into the laser. The time between transmission of a signal from the laser, and receipt of the reflected signal in the laser, is input to a computer 148 in the housing 134. Similarly, signals from the computer 148 and coupled to transducer 141 activate the transducer to transmit ultrasonic signals downward through the pipe tube 137 as indicated by the dashed curved lines 151, to engage the target and be reflected back to the transducer for output to the computer 148.

If the intended target is the liquid surface, and it happens that the nature of the cargo in the tank, or the overall environment in the tank is such that laser signals or ultrasonic signals are not reliably reflected back up into the tube from the surface, a float such as 152 in FIG. 22 can be used in a portion of the receiver and target assembly 132 to be described hereinafter. The float can be used to cause a target to float up or down as in the open ended pipe 57 of FIG. 12, as the level of the liquid surface 153 in tank 133 increases or decreases. Floats for such purposes are now known from my above-mentioned patents and U.S. Pat. No. 5,900,546 issued May 4, 1999.

Referring further to FIG. 15, the liquid containing holder tank 133 is shown only fragmentarily to conserve space in the drawing. A hole 156 is provided in the tank top 133T. A cylindrical flange 157 encircling the hole 156 is welded to the tank top 133T. A gasket 158 is mounted atop the flange. A receiver 159 has an external flange 161 which rests on the gasket. The receiver also has an internal circular flange 162 which, together with the internal cylindrical wall of the receiver below the flange, provides a downwardly-opening socket which receives the upper end portion of pipe 164 which is welded to the receiver 159. The internal cylindrical wall of the receiver above the flange 162, co-operates with the flange to provide an upwardly-opening socket 159S for receiving the lower end portion 137L of the signal transmission tube 137 when a measurement of the liquid level is to be made.

To secure the receiver, and thereby the pipe 164 in place, a cylindrical cap 166 is slipped down the top of the receiver. The cap has a cylindrical recess 167 in the bottom surface receiving the flange 161 of the receiver. Therefore, when a circular array of cap screws is installed through cap 166 and threaded into the flange 157, the receiver flange 161 is clamped onto the gasket 158 to secure the receiver and, thereby the pipe 164, in place on the tank. It is preferred that, when the pipe with receiver thereon has been installed on the tank, the attachment be tight enough that there be no movement of the pipe relative to the tank such that a change in tank attitude between the time of one measurement to the time of another measurement would result in measurement levels that would not both be representative of the liquid volume, due to change in attitude of the tank between the time of one measurement and the time of another measurement. The ideal is to have the tank attitude the same for all measurements, and the pipe axis 171 vertical for all measurements. The lower end 164E of the pipe is near or at the bottom 133B of the tank as shown in FIG. 22. The pipe is closed with a plug 169 at the bottom to prevent entry of the tank contents into the pipe.

Figure 22:
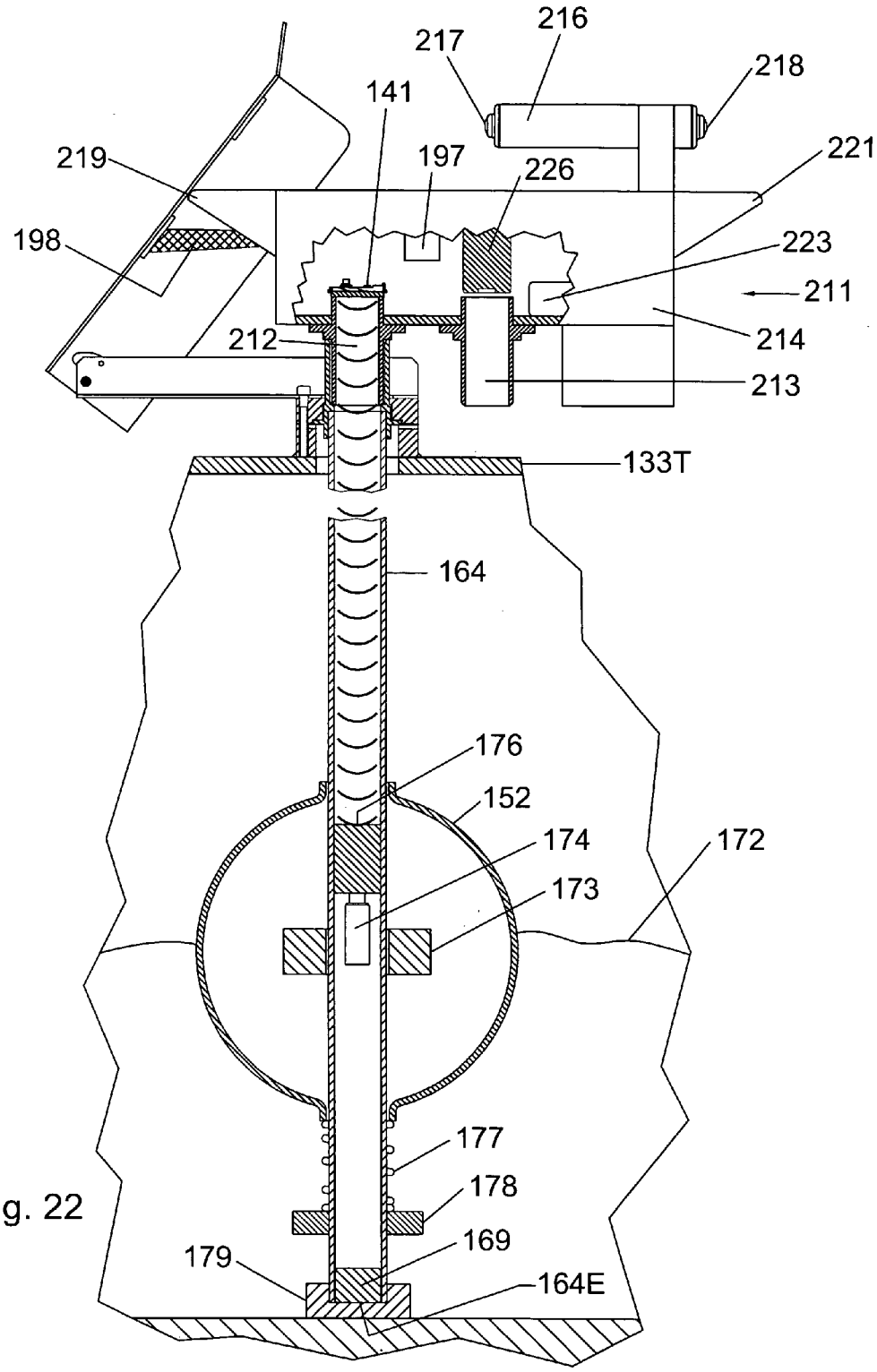
FIG. 22 is a side view of an eighth embodiment of the present invention installed in a tank (shown fragmentarily) and arranged to obtain a surface level measurement ultrasonically.

Referring further to FIG. 22, the float 152 is centered on the pipe 164 and can slide up and down on the pipe in response to rise and fall of the surface 172 of the liquid in the tank. The float contains a magnet 173 encircling the pipe. Float follower 174 is magnetically supported by the magnet and has a target 176 mounted on top of the float follower for reflection of ultrasonic and laser signals transmitted down the pipe from the transducer and from the laser. A spring 177 resting on the disk 178 fixed to the pipe 164 is in place to support the float whenever the liquid content of the tank is low as shown in FIG. 22. Of course the length of the pipe and the dimensions and shape of the float can be tailored to the type and depth of the tank where installed. Also, if desired to prevent deflection of the pipe in a cargo tank during movement of liquid in the tank during transportation or when docked if in water or when on a hill of on land, suitable bracketing for anchorage to the bottom of the tank, or otherwise, can be provided. An example is a socket 179 fixed to the bottom of the tank and receiving the lower end of the pipe 164.

Referring again to FIGS. 15 and 16, a cover assembly 181 is shown in section taken in a vertical plane containing the axis 171 of the pipe 164. A mounting bracket 182 is a generally U-shaped channel having a base portion 183 and a pair of horizontally-spaced upturned side walls 184 (only one is shown as these are sectional views). The base has a hole receiving the socket 159S through it and is fixed to the cap 166 by the cap screws 168. A cover 186 of inverted channel shape is mounted to the base by hinge pins 187 received through the side flanges 184 of the bracket and through the side walls 188 of the cover 186. So the cover can be raised from a closed condition in which the cover top 186T is horizontal, to a position such as in FIGS. 15 and 16, enabling the measurement assembly to be installed on the receiver and target assembly 132 by simply sliding the lower portion 137L of the measurement assembly into the socket 159S. It is important that the fit of the measurement assembly with the receiver, while a sliding fit, be close enough to keep the laser beam from striking the wall of the pipe.

There is a travel stop pin 189 fixed in the bracket wall 184 and received in the slot 191 in the side wall 186W of the cover to prevent the cover from swinging back too far. The cover hinge pins and stop slot are located such that the center of gravity of the cover is always tending to close the cover.

As it is desirable for measurement records made by a portable measuring instrument to be related to the tank where a measurement is made, there is a bar code 196 provided on the underside of the cover top 186T. For an example, where the measurements are to be made on a tanker, the code can be arranged to identify the tanker, and the particular one of a plurality of tanks in the tanker. There is a bar code reader 197 in the housing 134 and which projects a beam 198 from the end of the housing 134. When the measurement assembly is in place on the receiver socket, the projection 199 at an end of the instrument housing 134 serves to stop the return of the cover toward the pipe closing condition. The end of the projection 199 will engage the underside of the cover and stop its return toward the closed condition at an attitude such that the bar code 196 is in the optimum position for exposure to the beam 198 from the code reader 197. To seal the socket 159S closed when the portable measurement assembly is removed, the cover has a gasket 200 on the underside of the cover and which engages and closes the upper end of the socket when the cover returns by gravity to the horizontal position.

Figure 25:
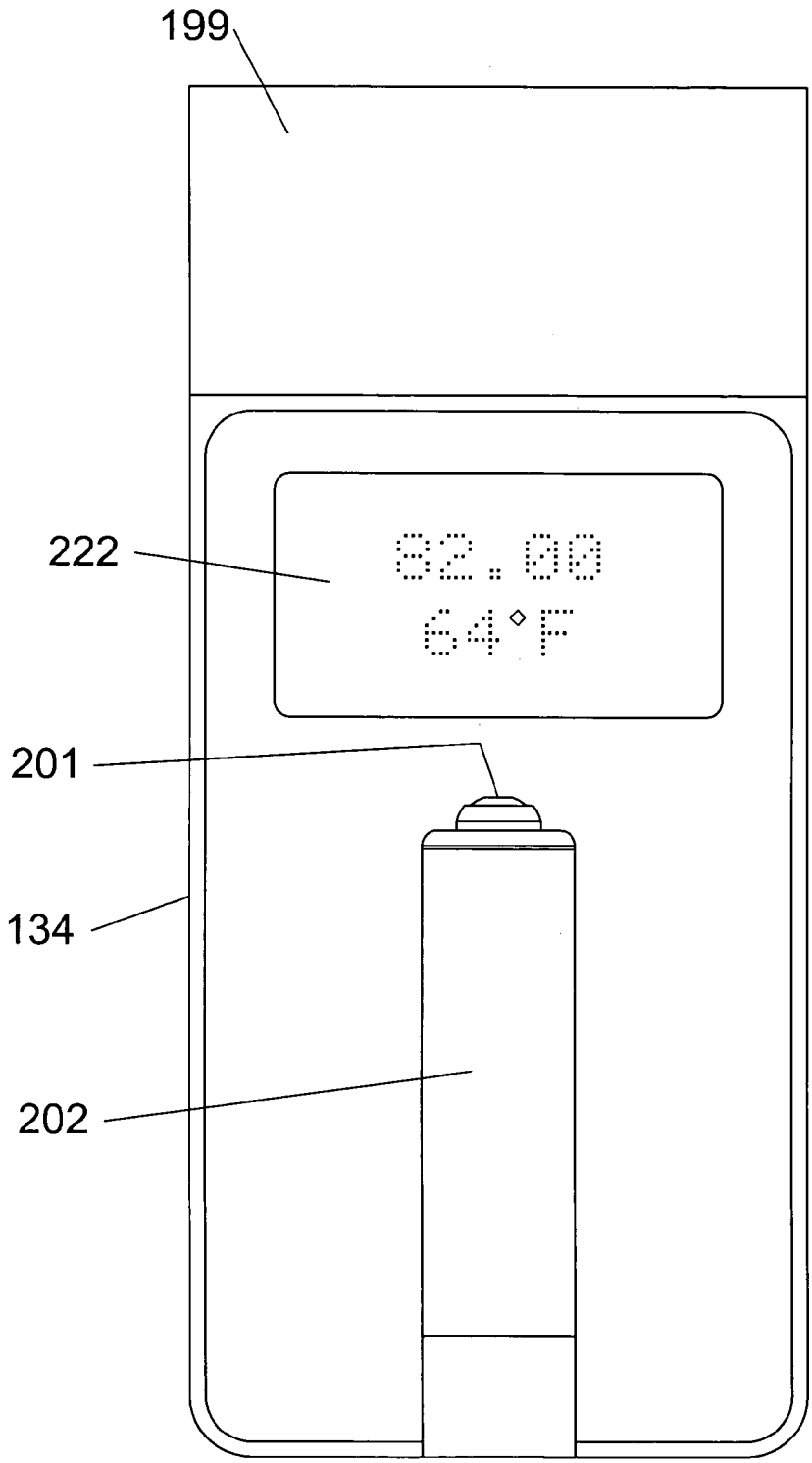
FIG. 25 is a top view of the portable measuring instrument showing the display of temperature and liquid surface level.
Figure 26:
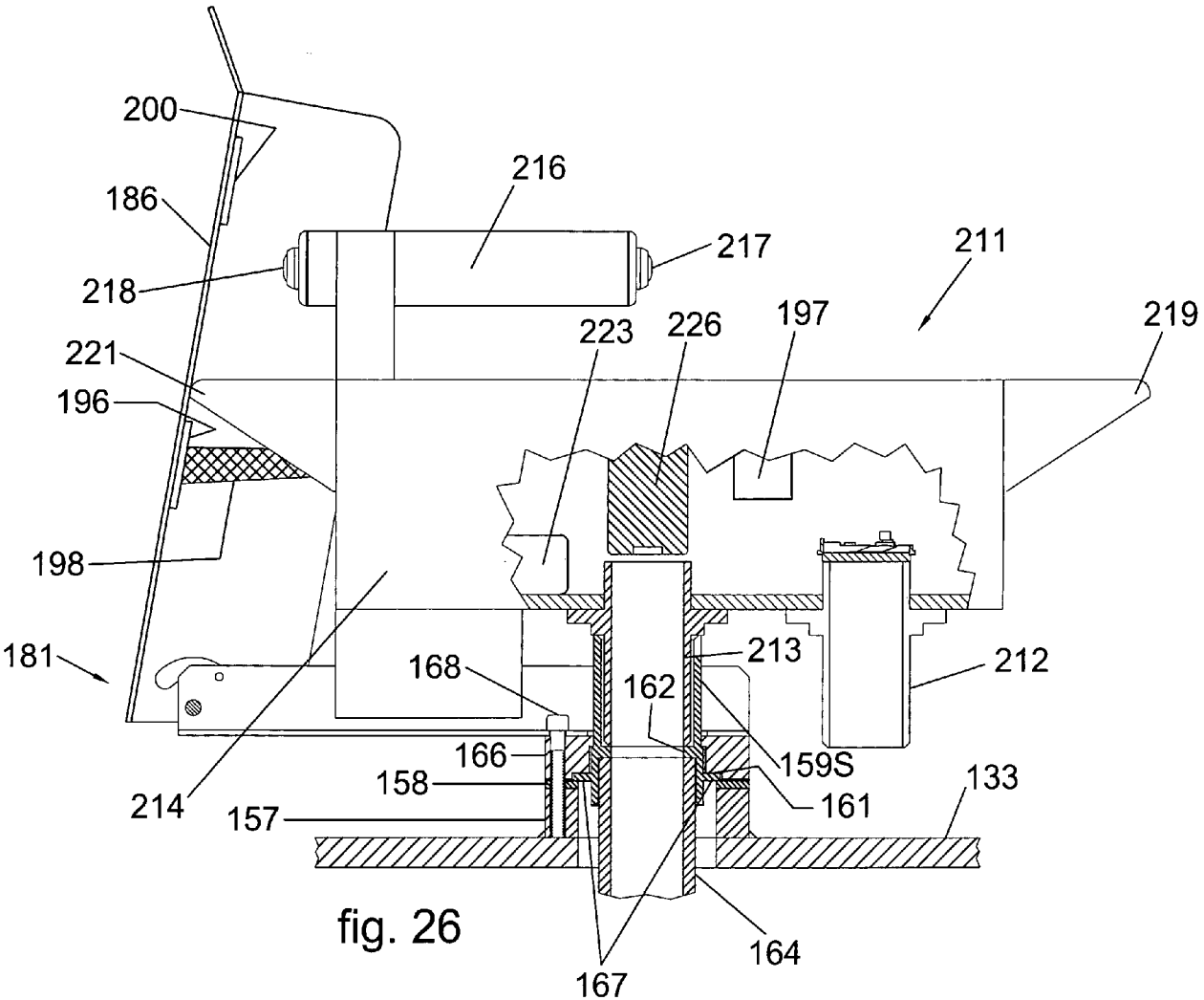
FIG. 26 is an enlarged view of the portable measurement assembly of the embodiment shown in FIG. 23.

In the embodiment of FIGS. 15 and 16, the laser signals and ultrasonic signals functions are done on a time sharing basis, initiated by pushing the button 201 on the end of the carrying handle 202. This will produce a display such as shown in FIG. 25 representing a surface level measurement of 84 inches from some reference point, and a liquid temperature of 64 degrees Fahrenheit. Such information can be used to compare with information obtained at a different time to determine whether there has been any loss of liquid from the tank between the times of measurement.

Figure 17:
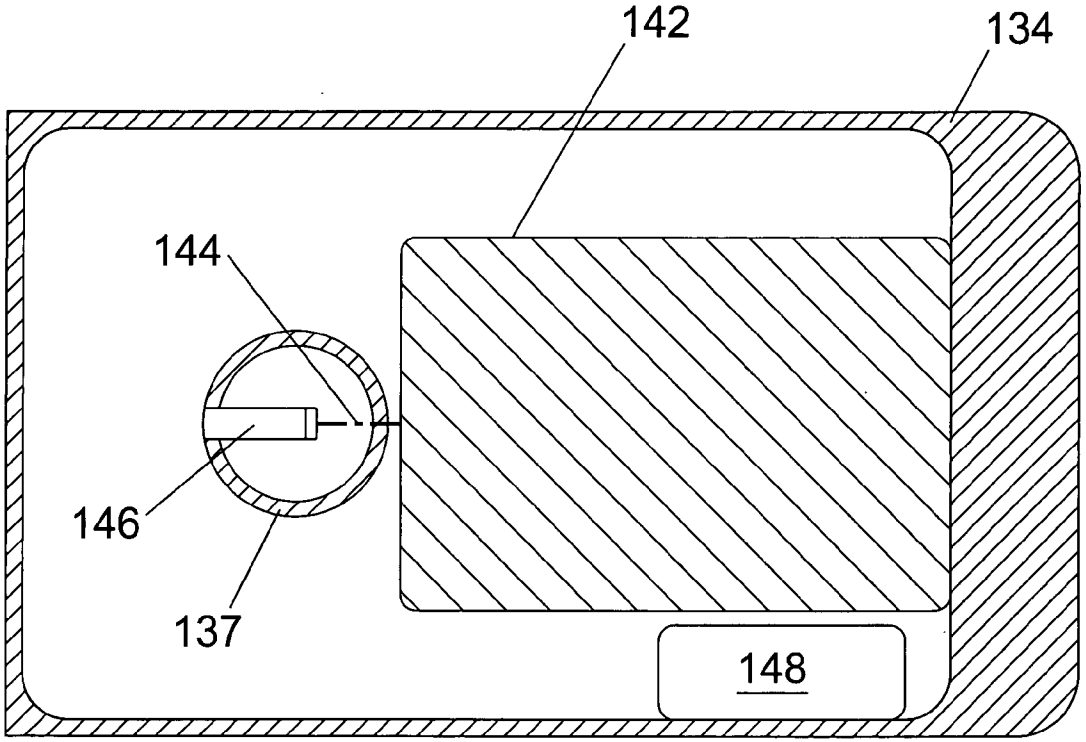
FIG. 17 is a section taken a line 17—17 in FIG. 16 and viewed in the direction of the arrows.
Figure 18:
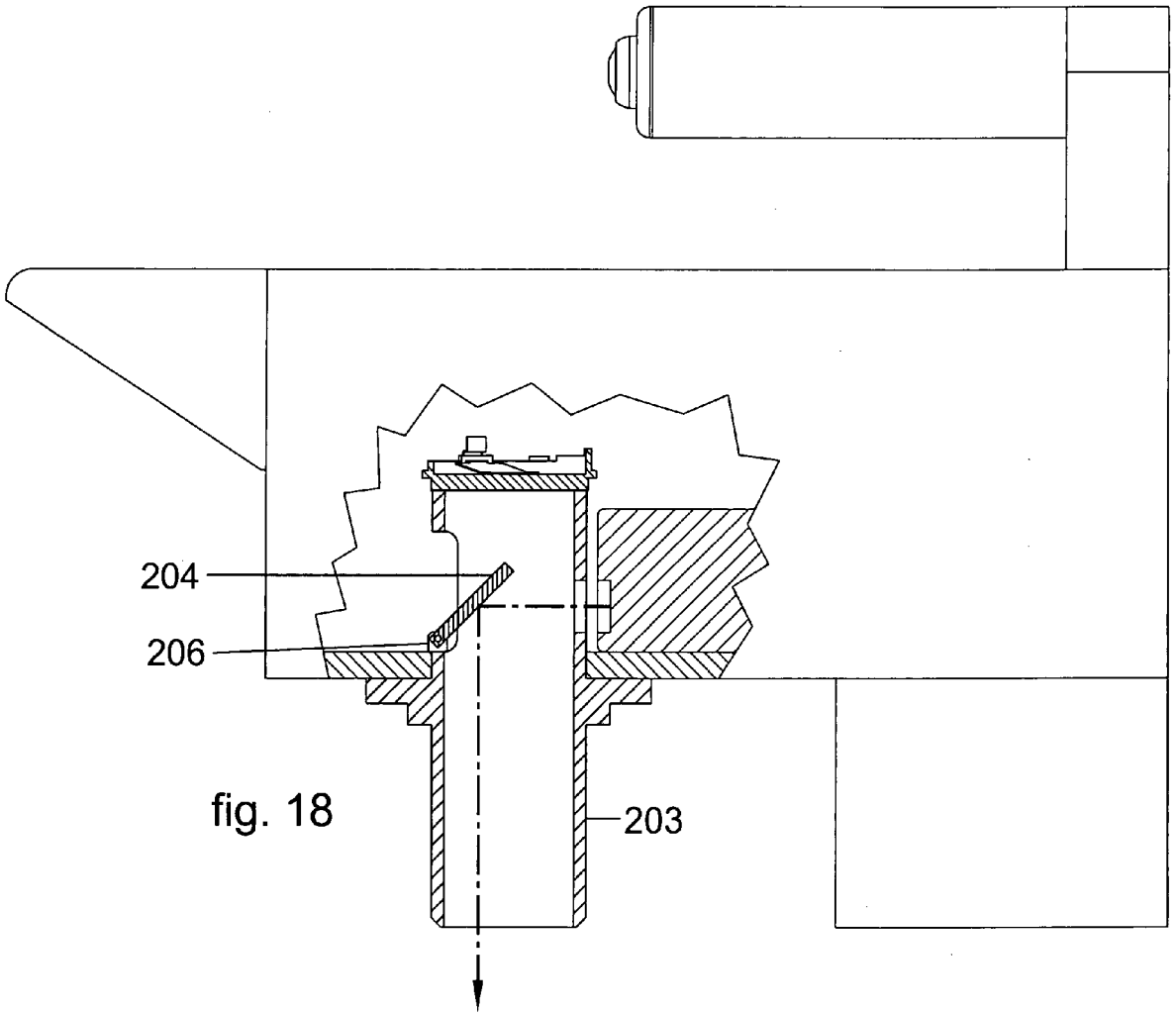
FIG. 18 is a side view of liquid level measurement apparatus showing, partially in section, a sixth embodiment of the present invention having a laser beam deflector in active position.
Figure 19:
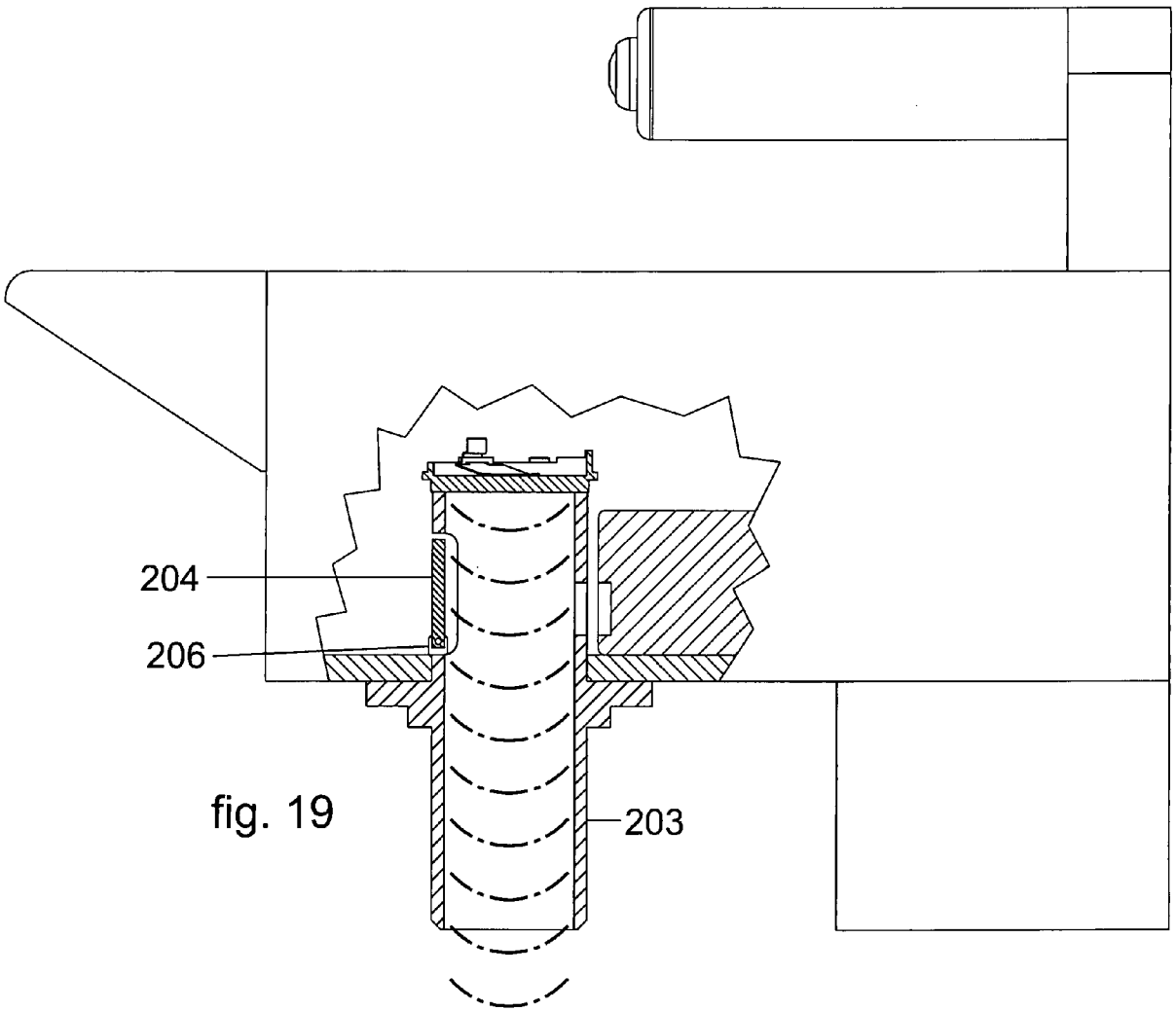
FIG. 19 is a side view of the embodiment of FIG. 18 but showing in section, the laser beam deflector in an inactive position.

Referring now to FIGS. 18 and 19, the portable measurement assembly is essentially the same as described above with reference to FIGS. 15–17. But in this instance, the signal transmission tube 203 is provided with a reflector 204 which is pivoted at 206 so that it can be moved from the active orientation of FIG. 18, which it has during a laser transmission and reception, to a passive position shown in FIG. 19 for ultrasonic transmission and reception.

Figure 20:
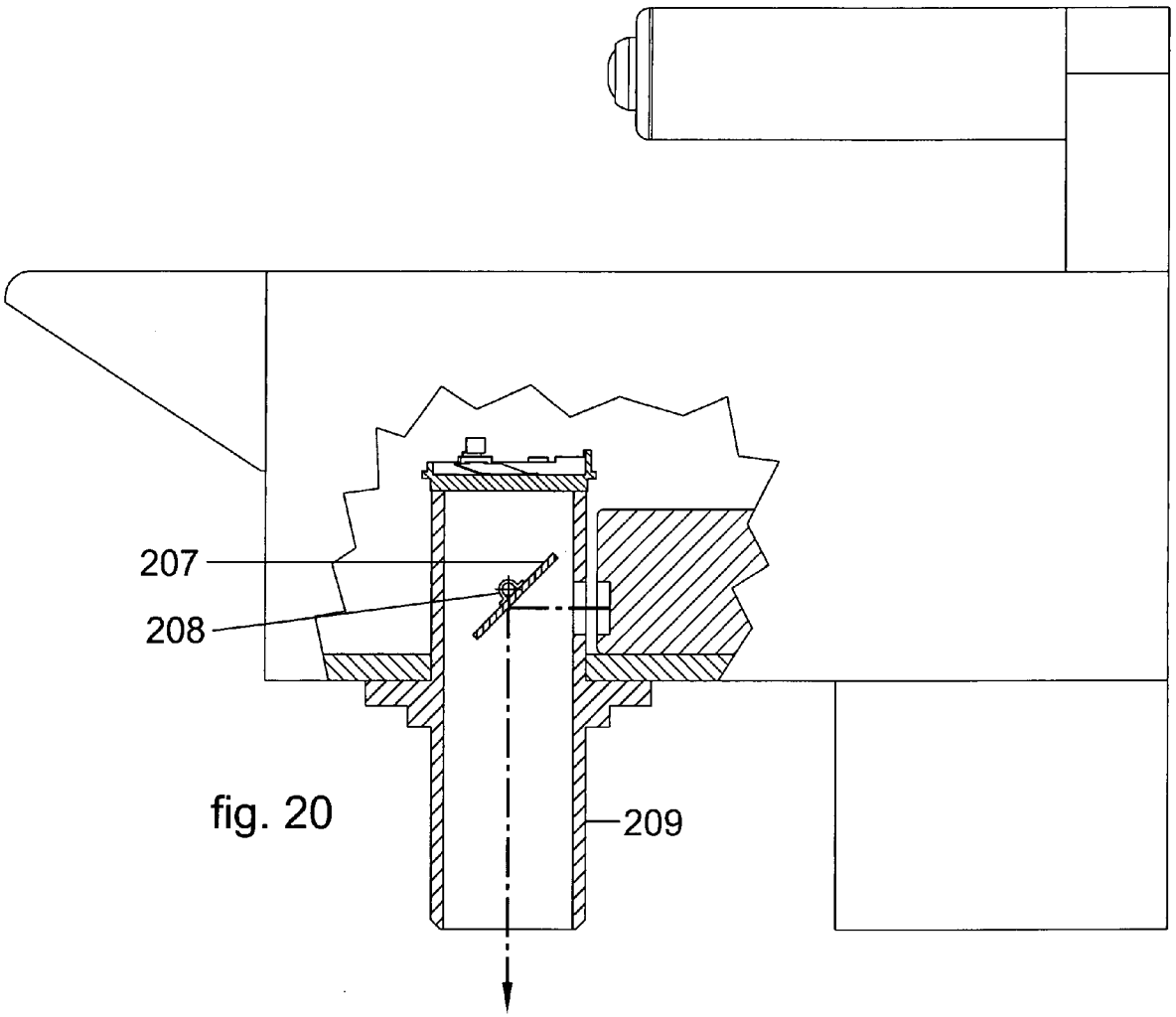
FIG. 20 is a side view of liquid level measurement apparatus showing, partially in section, a seventh embodiment of the present invention.
Figure 21:
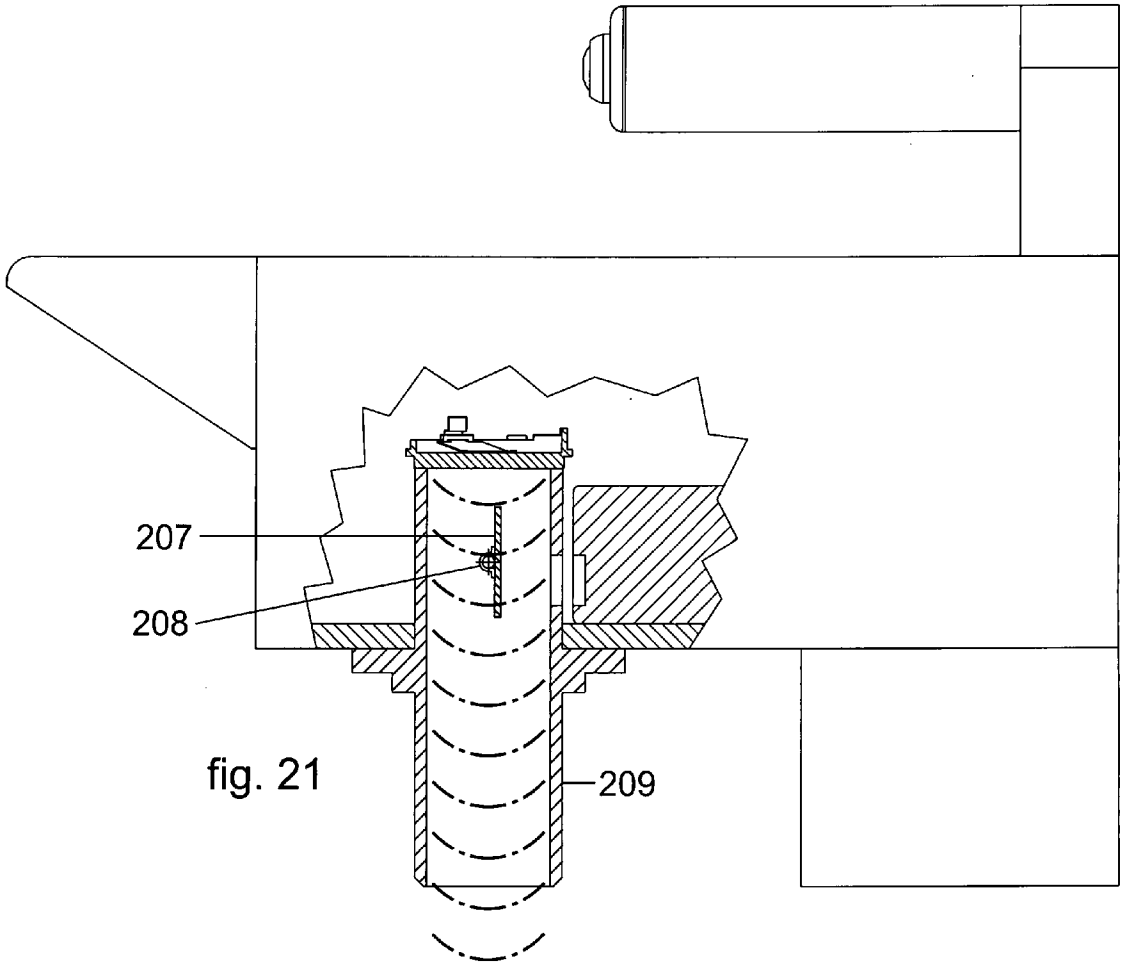
FIG. 21 is a side view of the apparatus of FIG. 20 showing the laser beam deflector in a neutral position.

Referring now to FIGS. 20 and 21, the portable measurement assembly is essentially the same as in FIGS. 15–19. But in this instance, the reflector 207 is pivoted on an axle 208 through the wall of the tube 209. It is in the orientation shown in FIG. 20 during actuation of the laser, but is alternated to the orientation shown in FIG. 21 during actuation of the ultrasonic transmission and reception function.

Operation

In the use of the apparatus of the embodiments of FIGS. 15–21, it is preferred that transmission and reception of the laser beam be conducted separately from transmission and reception of ultrasonic signals. In the embodiments of FIGS. 18 and 20, some means associated with the alternating between laser and ultrasonic transmission, will be used to change the attitude of the reflectors to enable the 90 degree turning of the laser beam during laser transmission and reception, but essentially remove the reflector from the ultrasonic transmission and reception, particularly in the embodiment of FIGS. 18 and 19.

The use of the two surface level measurement approaches, ultrasonic and laser enables the use of the single tube. The laser transmission and reception is used for precise measurement of the distance to the surface of the liquid and, thereby determine the liquid surface level with reference to some established base level that is fixed relative to the tank. Thus, when the surface level is known, the depth of liquid in the tank will be known. In some barges, for example, the tanks are about thirteen feet deep. The use of the ultrasonic approach is to obtain a measurement which may be impacted by the temperature of the atmosphere in the signal transmission tube and pipe and which would not affect the laser measurement. Therefore, by comparing the measurement indicated by the laser with the measurement indicated by the ultrasonic transducer, and knowing the distances from a fixed reference point on the signal transmission tube, for example, to the transducer and to the laser, the impact of the temperature on the accuracy of the ultrasonic measurement can be determined. From this information and information on the impact of temperature on sound velocity in an atmosphere, stored in the computer 148, the temperature at which a match of the laser measurement of liquid level with ultrasonic measurement of liquid level can be derived instantly.

The next time that the level of liquid is measured, whether it be at a port or some other unloading or loading station, there is a likelihood that the temperature will be different. Measurements by the laser and the ultrasonic transducer can be made at that time in the same way as made during the previous measurement. The temperature can be calculated in the same way also. Knowing that information and knowing the characteristics of the liquid with the temperature, a determination can be made whether any liquid has been lost between the time of the first measurement and the time of the next successive measurement.

In some cases, there is interest in the level of liquid in holders, and no particular interest in the impact of temperature. An example is in a tank farm, where the levels in all tanks will be checked at about the same time and at the same temperature. In such instances, apparatus having features according to the present invention need not incorporate the ultrasonic portions.

Figure 23:
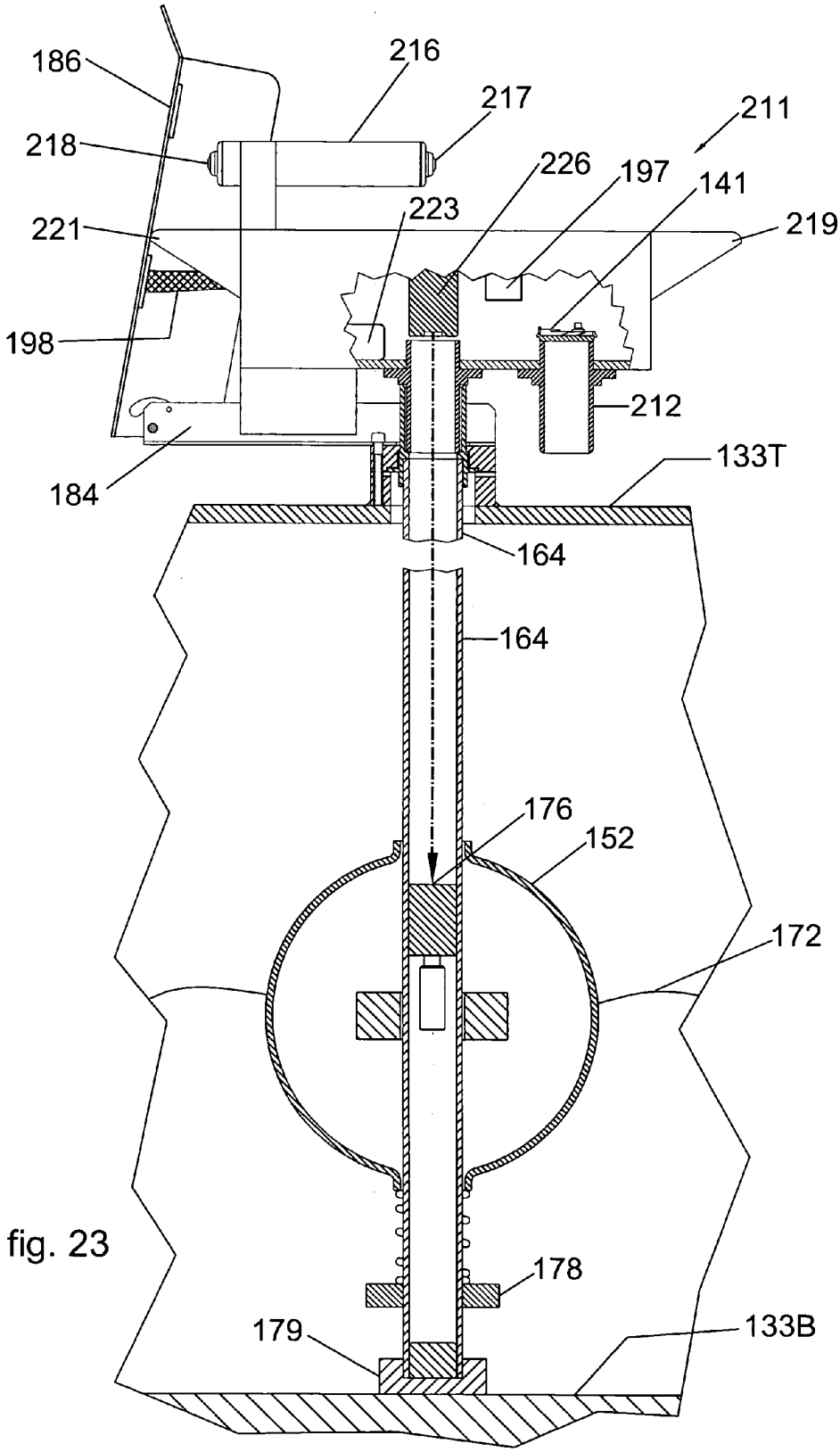
FIG. 23 is a side view of the eighth embodiment of the present invention installed in a tank (shown fragmentarily) and arranged to obtain a surface level measurement by laser.

Referring now to FIG. 22, which was mentioned previously for its disclosure of a receiver and target assembly incorporating the present invention, the portable measurement assembly 211 is the same in many respects as those in FIGS. 15–21. But in this embodiment, there are two signal transmission tubes, 212 and 213, at longitudinally spaced locations on the base of the housing 214. The laser 226 is mounted in the housing so that the beam is directed down the center of the tube 213. Each tube is separately receivable in the socket 159S. In FIG. 22 tube 212 is shown received in the socket and has the ultrasonic transducer 141 mounted at the top of the tube. Thus it can transmit and receive ultrasonic signals as in the previously described embodiments. The handle 216 has a button 217 at one end to activate the ultrasonic measurement. Then, to make the laser measurement, and using handle 216, the assembly can be pulled out of the socket 159S and turned around and placed with the tube 213 in the socket 159S as shown in FIG. 23. Then the laser measurement can be taken by pressing the button 218 at the other end of the handle 216. The stop 219 at the one end of the housing 214 holds the cover at the right attitude for reading the bar code during the ultrasonic measurement, while the stop 221 at the other end holds the cover at the right attitude for reading the bar code during the laser measurement. The bar code reader 197 can project a beam from both ends of the housing and which can be useful to provide assurance that two successive measurement readings, one with ultrasonic and the other with laser, have been made on the same tank. The sequence of readings can be laser first followed by ultrasonic, or visa versa. When both measurements have been made, and the ultrasonic measurement processed to establish the temperature, the result can be displayed in the window 222 as shown in FIG. 25. The data can also be recorded in the computer for wired or wireless downloading from a transmitter 223 to data storage at some other location for later use. Following measurement of liquid level at one tank, the measurement assembly can be lifted off the tank by the operator, and carried to another tank to obtain measurements of liquid level in that tank, an so on. As mentioned above, in this embodiment of FIGS. 22 and 23, the laser 226 is mounted to direct its beam vertically down the tube and pipe in the direction of arrow 147 along the axis 171 of the pipe. Reflections from the target, whether it be the liquid surface itself or a top surface of the target 176 return directly to the laser.

Figure 24:
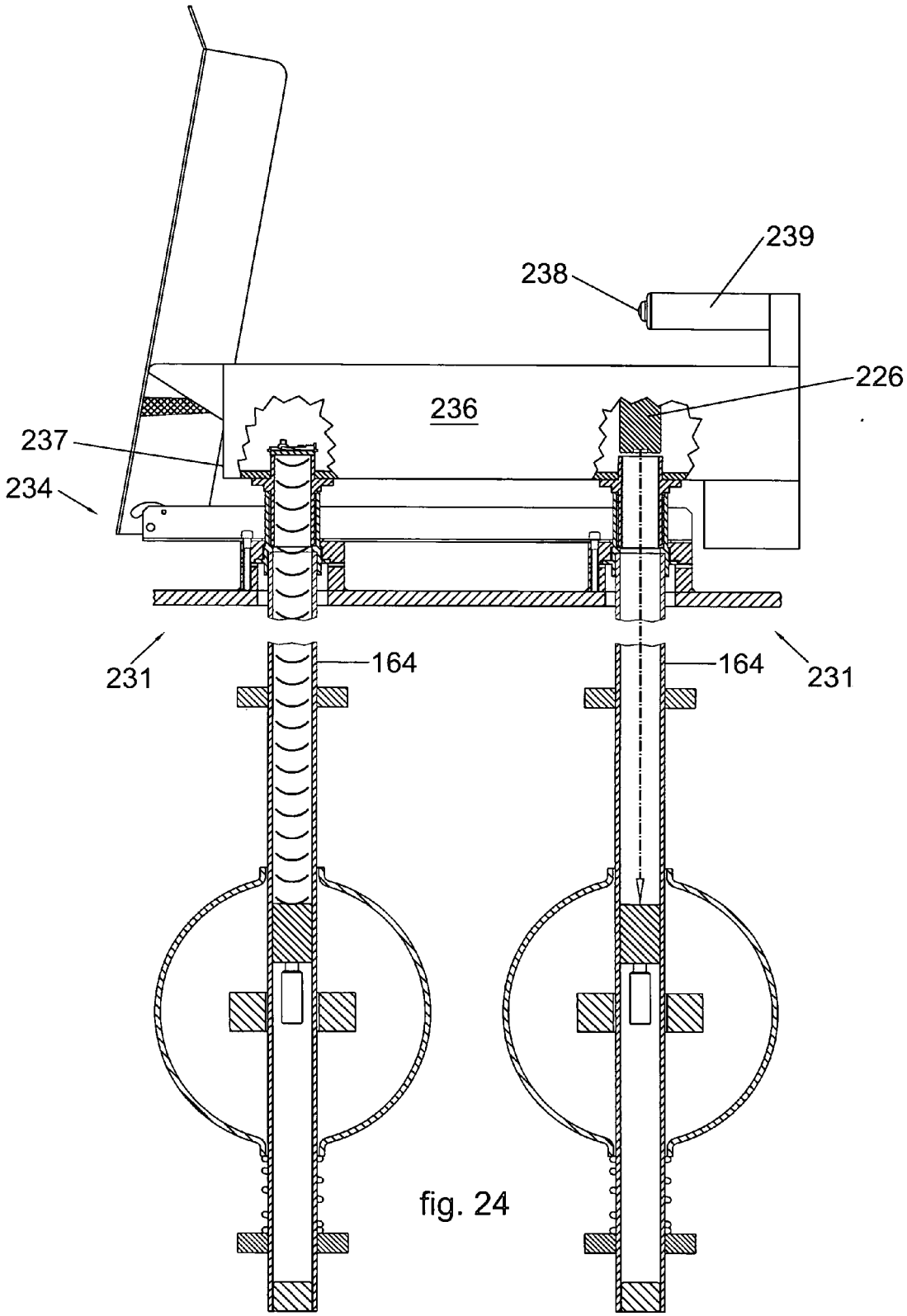
FIG. 24 is a side view, mostly in section, of a ninth embodiment of the present invention on a tank (shown fragmentarily).

Referring to FIG. 24, the measurement apparatus uses two receiver and target assemblies 231 which can be the same as the assembly of previously described FIGS. 15–23. The mounting to the tank top is the same. The bracket and cover assembly 234 is longer to accommodate coverage of the sockets such as 159S atop each of the pipes 164. A convenient pipe spacing may be 17 inches, for example. The housing 236 contains all of the components as described for the FIGS. 15–23 embodiments, but the code reading from the one end 237 is sufficient because this measurement assembly can make both ultrasonic and laser measurements directly while mounted one way. A single button 238 on the handle 239 can be used to cause both measurements and the signal processing to be made.

An example of a transducer suitable for use in practicing the present invention is Model No. XR-600 manufactured by Ocean Motions, P.O. Box 30, Barrington, R.I. 02806. An example of a laser suitable for use in the practice of the present invention is manufactured by Dimetix (Leica) DLS-A15, C4-9100, Hevisau, Switzerland. An example of a computer processor useful for making the above-mentioned calculations and comparisons is Model No. P87C51FB made by Intel of 2200 Mission College Blvd., Santa Clark, Calif. 95052. A useful bar code reader, for example, is Model SE1222WA1000A, manufactured by Symbol Technologies of One Symbol Plaza, Holtsville, N.Y. 11742.

In many cases, the owners of the cargo vessels, whether they be ships, railway tanker cars, tanker trucks or aircraft, have charts translating the level of cargo to actual volume or weight of cargo, depending upon the nature of the cargo itself and the shape of the container. It is possible to determine directly from such charts, the actual amount of cargo in terms of weight or volume, based upon the surface level of cargo in the container. Of course, such information is useful to determine whether or not there has been loss of cargo by evaporation, leakage, intentional discharge, or otherwise. It will be recognized that some choices in configuration and sequence and displays may be made within the scope of the invention and can be accommodated by software tailored to the desires of the customer and within the skill of the art. Therefore, while the invention has been illustrated and described in detail in the drawings and foregoing description, the same is to be considered as illustrative and not restrictive in character, it being understood that while various embodiments have been shown and described, all changes and modifications that come within the spirit of the invention are desired to be protected.

The invention claimed is:

1. Liquid level measurement apparatus for liquid in a holder and comprising:

a holder for containing liquid;

a vertical pipe secured to said holder, said pipe being arranged for at least partial submersion in said liquid;

a target in said pipe and arranged to rise and fall in synchronism with rise and fall of the surface of liquid in said holder;

a laser for transmitting signals longitudinally in the pipe to impinge on said target in the pipe to be reflected by said target back to said laser;

a computer coupled to said laser to compare time of transmission of said signals by said laser, with time of reception by said laser of said signals reflected back by said target, and determine the level of the surface of said liquid in said holder;

a signal transmission tube coupled to said laser for said signals transmitted by said laser into said pipe;

said pipe having a receiver arranged to receive said transmission tube for providing a passageway for signals produced by said laser, from said laser through said pipe to said target and for return of said laser signals reflected by said target, from said target to said laser;

said signal transmission tube and said receiver are configured to mate for establishing collinear axes of said transmission tube and said pipe for transmission of signals produced by said laser on said axis, from said laser to said target; and said transmission tube and said receiver are configured to mate by sliding said tube and said receiver together.

2. The apparatus of claim 1 and wherein:

said transmission tube has a lower end and an upper end; and said receiver has all upwardly opening socket to receive a portion of said tube adjacent said lower end of said tube to facilitate coupling said carrier to said pipe for transmission and reception of said laser signals, and for de-coupling said carrier from said pipe for transporting to another liquid holder.

3. Liquid level measurement apparatus for liquid in a holder and comprising:

a holder for containing liquid;

a vertical pipe secured to said holder, said pipe being arranged for at least partial submersion in said liquid;

a target in said pipe and arranged to rise and fall in synchronism with rise and fall of the surface of liquid in said holder;

a laser for transmitting signals longitudinally in the pipe to impinge on said target in the pipe to be reflected by said target back to said laser;

a computer coupled to said laser to compare time of transmission of said signals by said laser, with time of reception by said laser of said signals reflected back by said target, and determine the level of the surface of said liquid in said holder;

a signal transmission tube coupled to said laser for said signals transmitted by said laser into said pipe;

said pipe having a receiver arranged to receive said transmission tube for providing a passageway for signals produced by said laser, from said laser through said pipe to said target and for return of said laser signals reflected by said target, from said target to said laser;

a carrier coupled to said laser for lifting said laser from said receiver on said liquid holder following measurement of the level of the surface of liquid in said holder, and for carrying said laser to a receiver like said first-mentioned receiver but located on another liquid holder to measure the level of the surface of a liquid in said another liquid holder; and a pipe cover pivotally mounted to said holder to pivot from a first, receiver-covering orientation, to a second orientation enabling access to said receiver for receiving said transmission tube.

4. The apparatus of claim 3 and further comprising:

a code on the inside of said cover for identifying the holder to which said cover is mounted; and a code reader mounted to said carrier for reading said code when said transmission tube is received in said receiver.

5. The apparatus of claim 4 and further comprising:

a stop on said carrier and positioned to support said cover in position for reading said code by said code reader when said transmission tube is received by said receiver.

6. Liquid level measurement apparatus for liquid in a holder and comprising:

a holder for containing liquid;

a vertical pipe secured to said holder, said pipe being arranged for at least partial submersion in said liquid;

a target in said pipe and arranged to rise and fall in synchronism with rise and fall of the surface of liquid in said holder;

a laser for transmitting signals longitudinally in the pipe to impinge on said target in the pipe to be reflected by said target back to said laser;

a computer coupled to said laser to compare time of transmission of said signals by said laser, with time of reception by said laser of said signals reflected back by said target and determine the level of the surface of said liquid in said holder;

a signal transmission tube coupled to said laser for said signals transmitted by said laser into said pipe;

said pipe having a receiver arranged to receive said transmission tube for providing a passageway for signals produced by said laser, from said laser through said pipe to said target and for return of said laser signals reflected by said target, from said target to said laser;

an ultrasonic signal transducer;

a second signal transmission tube, said second tube being coupled to said ultrasonic signal transducer, and said second tube being receivable by said receiver for providing a passageway for ultrasonic signals produced by said transducer, from said transducer through said pipe to said target and for return of said ultrasonic signals reflected by said target, from said target to said transducer.

7. The apparatus of claim 6 and wherein:

said computer is coupled to said transducer to compare time of transmission of said ultrasonic signals by said transducer with time of receipt by said transducer of said ultrasonic signals reflected from said target to provide a measurement representative of the level of the surface of the liquid in the holder, and compare the level measured by the laser to the level as indicated by the transducer, and apply a temperature compensation factor to the level measurement by the transducer to match the level measurement by the laser, and output the temperature corresponding to said compensation factor that achieves the match.

8. The apparatus of claim 7 and further comprising:

a display representing measurement of the level of the surface of the liquid in the holder and the temperature of said atmosphere.

9. The apparatus of claim 7 and further comprising:

a second vertical pipe secured to said holder, said second pipe being arranged for at least partial submersion in said liquid;

a second target, said second target being located in said second pipe and arranged to rise and fall in synchronism with rise and fill of the surface of the liquid in said holder;

said second pipe having a receiver to receive said second signal transmission tube for providing a passageway for signals produced by said transducer, from said transducer to said second target, and for return of said transducer signals reflected by said target, from said target to said transducer.

10. The apparatus of claim 6 and wherein:

said transducer is mounted atop said second signal transmission tube.

11. Liquid level measurement apparatus for liquid in a holder and comprising:

a holder for containing liquid;

a vertical pipe secured to said holder, said pipe being arranged for at least partial submersion in said liquid;

a target in said pipe and arranged to rise and fall in synchronism with rise and fall of the surface of liquid in said holder;

a laser for transmitting signals longitudinally in the pipe to impinge on said target in the pipe to be reflected by said target back to said laser;

a computer coupled to said laser to compare time of transmission of said signals by said laser, with time of reception by said laser of said signals reflected back by said target, and determine the level of the surface of said liquid in said holder;

an ultrasonic transducer coupled to said signal transmission tube and oriented to project ultrasonic signals down through the tube and pipe and receive ultrasonic radiation up through the pipe; and wherein:

said laser is oriented to transmit signals horizontally through an opening in said pipe;

a reflector is provided on said pipe and oriented to reflect laser signals received horizontally and transmit said signals vertically down through said pipe, and receive signals reflected from said target up through the pipe and reflect the signals horizontally into the said laser; and wherein said computer is coupled to said transducer to compare time of transmission of said ultrasonic signals by said transducer with time of receipt by said transducer of said ultrasonic signals reflected from said target to provide a measurement representative of the level of the surface of the liquid in the holder, and compare the level measured by the laser to the level represented by the transducer measurement, and apply a temperature compensation factor to the level measurement by the transducer to match the level measurement by the laser, and output the temperature corresponding to said compensation factor that achieves the match.

12. The apparatus of claim 11 and wherein:

said reflector projects into said pipe from a side wall of said pipe and has a laser reflecting surface disposed at about 45 degrees from the path of a beam from the laser to reflect the laser beam downward along the axis of the pipe.

13. The apparatus of claim 11 and wherein:

said reflector is pivotally mounted to the wall of said pipe and is received in a recess in said wall for facilitating ultrasonic transmission of signals along the axis of said pipe, and wherein:

said reflector is pivotal into said pipe to a position disposed at about 45 degrees from the path of a beam from the laser to reflect the laser beam downward along said axis of said pipe.

14. The apparatus of claim 11 and wherein:

said reflector is pivotally mounted in the pipe for orientation of a reflecting surface of the reflector from a plane containing the axis of the pipe to a plane at a 45 degree angle to said plane to reflect a beam from the laser downward along the axis.

* * * * *

UNITED STATES PATENT AND TRADEMARK OFFICE

CERTIFICATE OF CORRECTION

PATENT NO. : 7,082,828 B1
APPLICATION NO. : 10/799221
DATED : August 1, 2006
INVENTOR(S) : Larry C. Wilkins It is certified that error appears in the above-identified patent and that said Letters Patent is hereby corrected as shown below:

In the Title Page, under the Assignee section, line 2, change "Albany, IN (US)" to --New Albany, IN (US)"--

In column 11, line 48, please change "said receiver has all upwardly opening" to --said receiver has an upwardly opening--

In column 12, line 47, please change "said target and determine the level" to --said target, and determine the level--

In column 13, line 21, please change "nism with rise and fill of the surface" to --nism with rise and fall of the surface--

Signed and Sealed this

Thirteenth Day of March, 2007

JON W. DUDAS
*Director of the United States Patent and Trademark Office*